US006296995B1

(12) United States Patent
Camp et al.

(10) Patent No.: US 6,296,995 B1
(45) Date of Patent: Oct. 2, 2001

(54) DIGITAL PHOTOGRAPHIC ELEMENT WITH BIAXIALLY ORIENTED POLYMER BASE

(75) Inventors: Alphonse D. Camp, Rochester; Peter T. Aylward, Hilton; Robert P. Bourdelais, Pittsford, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/480,896

(22) Filed: Jan. 11, 2000

(51) Int. Cl.[7] ..... G03C 7/26; G03C 7/30; G03C 7/34; G03C 7/38; G03C 1/79

(52) U.S. Cl. ..... 430/505; 430/363; 430/503; 430/534; 430/536; 430/604; 430/605

(58) Field of Search ..... 430/363, 536, 430/503, 505, 534, 604, 605

(56) References Cited

U.S. PATENT DOCUMENTS

| | | | | |
|---|---|---|---|---|
| 5,264,337 | | 11/1993 | Maskasky . | |
| 5,266,454 | | 11/1993 | Diehl et al. . | |
| 5,340,703 | | 8/1994 | Masumi et al. . | |
| 5,360,712 | | 11/1994 | Olm et al. | 430/567 |
| 5,503,970 | | 4/1996 | Olm et al. . | |
| 5,744,287 | | 4/1998 | Roberts et al. | 430/363 |
| 5,783,373 | | 7/1998 | Mydlarz et al. . | |
| 5,783,378 | | 7/1998 | Mydlarz et al. . | |
| 5,853,965 | * | 12/1998 | Haydock et al. | 430/536 |
| 5,866,282 | | 2/1999 | Bourdelais et al. | 434/536 |
| 5,948,601 | | 9/1999 | Rieger . | |
| 6,020,116 | | 2/2000 | Camp et al. | 430/536 |
| 6,030,742 | | 2/2000 | Bourdelais et al. | 434/536 |
| 6,030,759 | | 2/2000 | Gula et al. | 430/536 |
| 6,043,009 | | 3/2000 | Bourdelais et al. | 430/536 |

* cited by examiner

*Primary Examiner*—Richard L. Schilling
(74) *Attorney, Agent, or Firm*—Paul A. Leipold

(57) ABSTRACT

The invention relates to A reflective base photographic element comprising a support material comprising a micro-voided biaxially oriented polymer sheet having an upper surface L* of at least 93.5 and imaging layers wherein said imaging layers have an exposure range of between 125 to 0.5 when there is a Status A reflection density shoulder loss of no more than 8 percent as a function of the cyan record, wherein said photographic element has an exposure range of at least 125 nanoseconds to 0.5 seconds when there is a Status A reflection density shoulder loss of no more than 8 percent as a function of the magenta color record, wherein said photographic element has an exposure range of at least 125 nanoseconds to 0.5 seconds when there is a Status A reflection density shoulder loss of no more than 4 percent as a function of the yellow color record, and wherein said photographic element has a Status A reflection density minimum of less than 0.100 in the cyan layer, has a Status A reflection density minimum of less than 0.100 in the magenta layer, has a Status A reflection density minimum of less than 0.08 in the yellow layer, and a modulation transfer function (MTF) of at least 78.0, and a cyan Dmax of at least 2.53, a magenta Dmax of at least 2.34, and a yellow Dmax of at least 2.16.

17 Claims, 1 Drawing Sheet

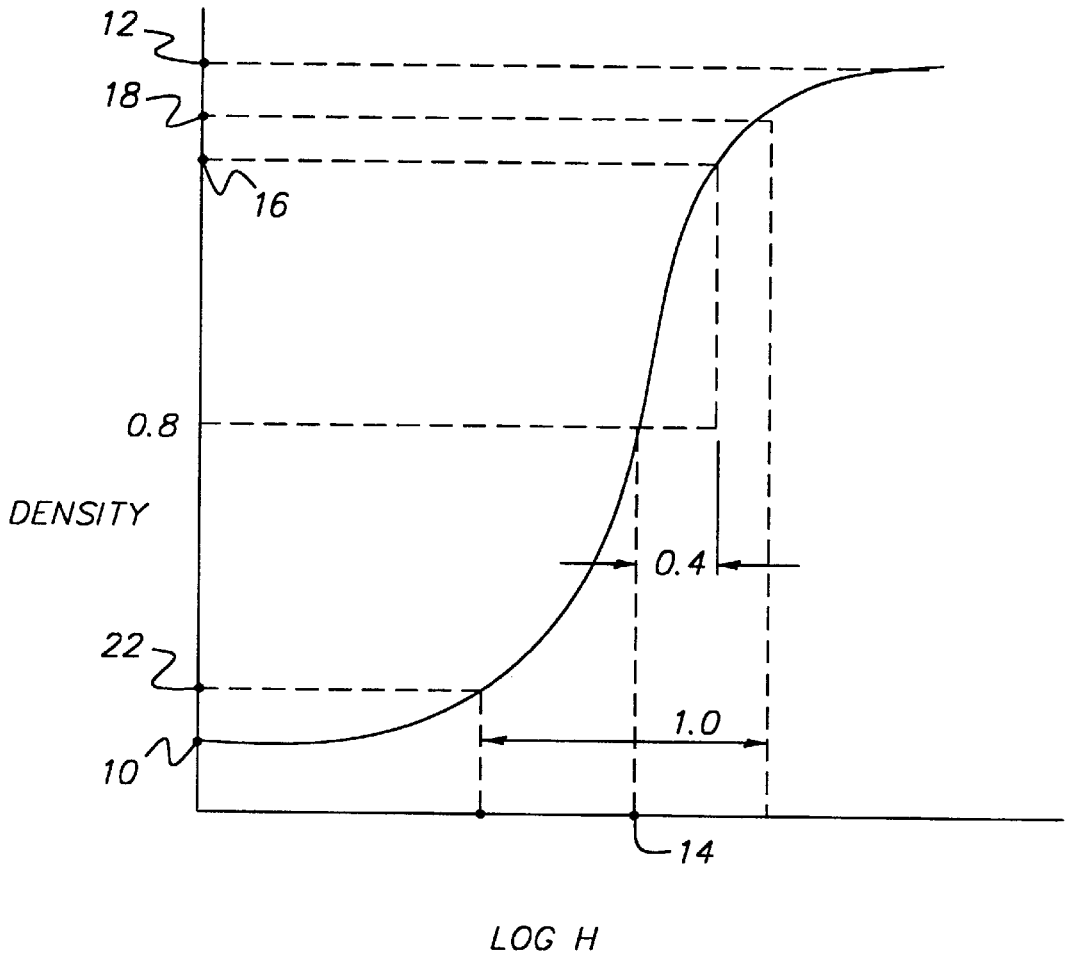
12
18
16
0.8
DENSITY
0.4
22
1.0
10
14
LOG H

DIGITAL PHOTOGRAPHIC ELEMENT WITH BIAXIALLY ORIENTED POLYMER BASE

FIELD OF THE INVENTION

This invention relates to photographic materials. It particularly relates to color photographic base materials containing microvoided biaxially oriented polymer sheets utilizing digitally compatible silver halide imaging layers.

BACKGROUND OF THE INVENTION

It has been proposed in U.S. Pat. No. 5,866,282 Bourdelais et al., to utilize a composite support material with laminated biaxially oriented polyolefin sheets as a photographic imaging material. In U.S. Pat. No. 5,866,282, biaxially oriented polyolefin sheets are extrusion laminated to cellulose paper to create a support for silver halide imaging layers. The biaxially oriented sheets described in U.S. Pat. No. 5,866,282 have a microvoided layer in combination with coextruded layers that contain white pigments. The composite imaging support structure described in U.S. Pat. No. 5,866,282 has been found to be more durable, sharper and brighter than prior art photographic paper imaging supports that use cast melt extruded polyethylene layers coated on cellulose paper.

It has been proposed in U.S. Pat. No. 5,744,287 that digital printing artifacts could be reduced by improvements of the image support materials. Improvements such as sharpness and minimum density would reduce certain digital printing artifacts and improve image quality.

Of the artifacts associated with printing digital images onto silver halide media, formation of visually soft or "bleeding" edges, especially around text, probably elicits the greatest objections. In the current invention this artifact is designated "digital fringing", and it pertains to unwanted density formed in an area of a digital print as a result of a scanning exposure in a different area of the print, not necessarily in adjacent pixels. Digital fringing may be detected in pixels many lines away from area(s) of higher exposure, creating an underlying minimum density or Dmin that reduces sharpness and degrades color reproduction. It should not be confused with system flare arising from improper calibration, which produces a similar macroscopic defect.

Digital fringing may be observed even with exposures producing mid scale densities. The minimum exposure at which digital fringing becomes visually objectionable varies by digital printing device and emulsion photographic properties. Because fringing increases with exposure, the useful density range for typical commercial color photographic papers printed by scanning laser or LED (light emitting diode) exposures must be restricted to 2.2 or below, less than the full density range of the papers. Fine line images require even lower print densities due to the acute sensitivity of the eye to softening of high contrast edges.

Other image artifacts associated with optical scan printing on silver halide media that should not be confused with digital fringing are "contouring", "banding", and "rastering". "Contouring" refers to the formation of discrete density steps in highlight regions where the gradations should appear continuous. Bit limited system modulators (those that use $\leqq 2^{10}$ bits, or 1024 DAC levels, designated 10 bit), may have too few levels to calibrate for density differences that are below the detection threshold of the human eye. A single bit change in exposure may, therefore, produce a density change large enough to see as a step, or contour. Lower contrast toe regions of the paper H&D curves can alleviate contouring in a 10 bit system, as taught by Kawai, Kokai JP 05/142712-A, but the low contrast also lowers the density threshold for digital fringing. System modulators using $2^{12}$ bits (designated 12 bit, having 4096 DAC levels) are not as susceptible to contouring artifacts. "Banding" is the appearance of lines, or bands, having a lower frequency than the individual raster lines, but which are parallel to the line scan direction. The bands arise from non-uniformity in the overlap exposure between scans (e.g., from mechanical vibrations) causing fluctuations in exposure in the overlap areas large enough to produce a visually detectable difference in density. "Rastering" is a high frequency artifact related to non-optimal spot size or shape which allows the eye to resolve the individual scan lines.

Those skilled in the art will recognize that the optical properties of the media (the scattering of light by the emulsion layers and predominately the paper base) contribute in part to digital fringing, which is a loss of acutance or sharpness. A general discussion of acutance as it pertains to structure of photographic media can be found in Mees & James, *The Theory of the Photographic Process, 4th Edition,* Chapter 21. The spot shape and spot size used in scanning laser exposures also contribute to loss of sharpness.

Typical chemical negative working color papers are restricted with regards to tone scale or contrast levels due to the fact that the paper must print acceptably with a color negative. Digital only color papers, however are not restricted as the digital printing device can electromodulate the curve shape to provide an acceptable tone scale in the image. It would be desirable to have a color paper that would provide not only excellent tone scale to optimize image quality in a negative working system, but also provide sufficient reciprocity control to survive the extremely short exposure times typical in sub microsecond digital exposure devices.

PROBLEM TO BE SOLVED BY THE INVENTION

There is a need for color photographic materials on support base materials that provide improved imaging over a wide range of exposure times and with improved performance for digital imaging while substantially minimizing digital printing artifacts.

SUMMARY OF THE INVENTION

It is an object of the invention to overcome disadvantages of prior photographic products.

It is another object to provide color photographic materials that may be imaged over a wide range of exposure times with exceptional images being formed.

It is a further object to provide color paper materials that are durable, bright, and sharp.

These and other objects of the invention are accomplished by a reflective base photographic element comprising a support material comprising a microvoided biaxially oriented polymer sheet having an upper surface L* of at least 93.5 and imaging layers wherein said imaging layers have an exposure range of between 125 to 0.5 when there is a Status A reflection density shoulder loss of no more than 8 percent as a function of the cyan record, wherein said photographic element has an exposure range of at least 125 nanoseconds to 0.5 seconds when there is a Status A reflection density shoulder loss of no more than 8 percent as a function of the magenta color record, wherein said photographic element has an exposure range of at least 125 nanoseconds to 0.5 seconds when there is a Status A reflection density shoulder loss of no more than 4 percent as a function of the yellow color record, and wherein said photographic element has a Status A reflection density minimum of less than 0.100 in the cyan layer, has a Status A reflection density minimum of less than 0.100 in the magenta layer, has a Status A reflection density minimum of less than 0.08 in the yellow layer, and a modulation transfer function (MTF) of at least 78.0, and a cyan Dmax of at least 2.53, a magenta Dmax of at least 2.34, and a yellow Dmax of at least 2.16.

ADVANTAGEOUS EFFECT OF THE INVENTION

This invention provides a reflective photographic paper material that may be exposed over a wide range of exposure times and still provide exceptional image quality, with clear, sharp, and bright images.

BRIEF DESCRIPTION OF THE DRAWING

The FIGURE is an illustration of a D logH characteristic curve for a digital sub microsecond exposure.

DETAILED DESCRIPTION OF THE INVENTION

The invention has numerous advantages over prior practices in the art. The invention imaging elements provide the ability to have a single element hat may be exposed with substantially invariant results over a wide range of exposure times. The photographic element of the invention when digitally exposed at exposure times of about 125 nanoseconds produces a clear, bright, and sharp image while minimizing fringing or other undesirable artifacts. The photographic element when digitally exposed maintains an acceptable maximum density in, dark areas of the print, while also having the ability to print white whites in the white areas. The photographic element further has exceptional durability with great resistance to tearing and handling abuse which would deteriorate the image.

The optical performance of the photographic elements of the invention remains exceptional with optical exposure resulting in bright, sharp prints. It is a feature of this invention that prints made either optically or by digital exposure have substantially the same excellent characteristics. The color support materials of the invention have excellent backside characteristics with excellent writability, as well as the ability to be printed with multicolor indicia. The photographic element of the invention exhibits exceptional resistance to chemical degradation by environment gases such as oxides of nitrogen commonly found in urban areas. The element of the invention also exhibits exceptional resistance to degradation in image quality caused by exposure to sunlight or other sources of ultraviolet radiation. These and other advantages will be apparent from the detailed description below.

Surprisingly, when a digitally capable silver halide emulsions are combined with a biaxially oriented polymer base material, the image quality of the digital emulsion significantly improves compared to the performance of the same digital emulsion coated on typical base materials that do not contain biaxially oriented sheets. Silver halide emulsions that are digitally capable provide sufficient reciprocity control to survive extremely short exposure time typical of sub microsecond digital devices such as a laser exposure device and provide acceptable image quality. Biaxially oriented sheets, because they are smooth, bright and have a much lower base spread function compared to cellulose paper, significantly improve text fringing, banding, rastering and Dmax of a digitally capable emulsion thereby significantly improving the quality of the image. For example, for commercial silver halide display material that is printed with a laser, a biaxially oriented polymer sheet laminated to polyester provides superior image quality compared to the same digital emulsion coated on prior art polyester with incorporated white pigments. The quality differences are especially obvious when text, which is common to commercial display material, is printed with a laser. The base material containing the biaxially oriented polymer sheet has text that is clearer and sharper compared to the text printed on the polyester base with incorporated white pigments.

Further, it was found that the biaxially oriented sheets of the invention significantly improved the modular transform function for the red, green and blue signal equally. This finding was unexpected as prior art optical negative working silver halide emulsions coated on to bases that contained biaxially oriented sheets were not able to improve the red, green and blue signal simultaneously. Improving the red, green and blue MTF signal simultaneously improves the quality of the image over the range of colors being reproduced.

A fill color photographic imaging element has at least one layer comprising a cyan dye forming coupler, one layer comprising a magenta dye forming coupler, and one layer comprising a yellow dye forming coupler and produces when developed an image in full color. Imaging layers are layers that contain sensitized silver halide and dye forming coupler.

In order to provide an imaging element with reduced digital printing artifacts, a digitally capable emulsion set has been applied to a significantly improved base material that has the properties of increased image sharpness and improved whiteness and brightness a reflective base photographic element comprising a support material comprising a microvoided biaxially oriented polymer sheet having an upper surface L* of at least 93.5 and imaging layers wherein said imaging layers have an exposure range of between 125 to 0.5 nanoseconds when there is a Status A reflection density shoulder loss of no more than 8 percent as a function of the cyan record, wherein said photographic element has an exposure range of at least 125 nanoseconds to 0.5 seconds when there is a Status A reflection density shoulder loss of no more than 8 percent as a function of the magenta color record, wherein said photographic element has an exposure range of at least 125 nanoseconds to 0.5 seconds when there is a Status A reflection density shoulder loss of no more than 4 percent as a function of the yellow color record, and wherein said photographic element has a Status A reflection density minimum of less than 0.100 in the cyan layer, has a Status A reflection density minimum of less than 0.100 in the magenta layer, has a Status A reflection density minimum of less than 0.08 in the yellow layer, and a modulation transfer function (MTF) of at least 78.0, and a cyan Dmax of at least 2.53, a magenta Dmax of at least 2.34, and a yellow Dmax of at least 2.16 is preferred because the emulsion utilized in this invention can be printed with sub microsecond exposure times without significant reciprocity failure. Combining the digitally capable emulsion set with a superior reflective base that has the attributes of higher sharpness and better whiteness provides a unexpectedly superior digital capable photographic support material with reduced digital artifacts resulting from the printing process.

Biaxially oriented sheet improve the digital printing performance of silver halide digital imaging layers because the biaxially oriented sheets can be voided and $TiO_2$ can be concentrated to reduce base spread. The integral color layer on the top of the biaxially oriented sheet concentrates the colorant materials that are required to off set the native yellowness of the gelatin in the emulsion layers. By concentrating the colorant materials in a thin layer, the usage of colorant materials compared to prior art materials is reduced by 50% thus yielding a brighter support material. The biaxially oriented sheets of the invention have been oriented to provide stiffness and tear resistance to the photographic image.

Because the desirable optical properties of the biaxially oriented sheets are contained within the biaxially oriented sheets, the biaxially oriented sheets can be adhered to a variety of support materials for many consumer and professional product applications. For example, biaxially oriented polymer sheets can be adhered to cellulose paper to provide an excellent photographic member that can be digitally printed with consumer images. Biaxially oriented sheets adhered to a thick polyester base material and coated with a digital silver halide imaging layers can be used for a superior reflection display material for commercial advertisement in airports and museums. Biaxially oriented sheets adhered to voided polyester base and coated with a digital silver halide imaging layers can be utilized for a superior professional portrait material for wedding photographs. In all these examples, the performance of the digital emulsion is enhanced by a base material that comprises a biaxially oriented polymer sheet.

The terms as used herein, "top", "upper", "emulsion side", and "face" mean the side or toward the side of a photographic member bearing the digital imaging layers. The terms "bottom", "lower side", and "back" mean the side or toward the side of the photographic member opposite from the side bearing the photosensitive digital imaging layers or developed image.

When a microvoided biaxially oriented polymer sheet is laminated to a smooth base substrate such as polyester and combined with a digital compatible silver halide emulsion, major improvements in image sharpness, fringing, color saturation, highlight and shadow detail are noted. Furthermore the biaxially oriented sheet of the invention enable the use of a broader range of base substrate that provide a silky smooth tacticle feel and to provide an extremely stiff print that feels like a high quality postcard. The digital emulsion of this invention further enables the final print because a broader range of color may be applied to the subject or scene of the print. Through digital manipulation, subject matter is more easily modified thus enabling a broader use of the silver halide light sensitive emulsion. It is also possible to use text in combination with the picture and have superior D-max and D-min. Furthermore having a digital silver halide emulsion layer provides text with very clean sharp edges. Prior art optically exposed silver halide emulsion do not provide text with clean sharp edges with pure D-max. Since the microvoided biaxially oriented polymer sheet is laminated to a smooth polyester base, the D-min of the photographic element is exception. The low D-min achieved by this invention further enhances the high contrast of the digital emulsion providing an image that is very striking when compared to prior art images.

The layers of the biaxially oriented polyolefin sheet of this invention have levels of voiding, $TiO_2$, optical brightener, and colorants adjusted to provide optimum optical properties for image sharpness, lightness, and opacity. An important aspect of this invention is the voided polymer layer under the silver halide image layer. The microvoided polymer layer provides an improvement over prior art photographic bases for opacity, sharpness, and lightness. The biaxially oriented polymer sheet is laminated to a support material such as polyester or cellulosic substrate base for stiffness for efficient image processing, as well as consumer product handling. Lamination of high strength biaxially oriented polymer sheets to a base substrate such as polyester or even cellulose containing support significantly increases the tear resistance of the photographic element compared to present resin coated photographic paper. The biaxially oriented sheets are preferably laminated with an ethylene metallocene plastomer or ehtylene copolymers that provide good adhesion of the polymer sheet to the polyester base.

The biaxially oriented sheets used in the invention preferably contain an integral emulsion bonding layer which avoids the need for expensive priming coatings or energy treatments. The bonding layer used in the invention is a low density polyethylene skin on the biaxially oriented sheet. Gelatin based silver halide emulsion layers of the invention have been shown to adhere well to low density polyethylene. The integral bonding skin layer also serves as a carrier for the blue tints that correct for the native yellowness of the gelatin based silver halide image element. Concentrating the blue tints in the thin, skin layer reduces the amount of expensive blue tint materials when compared to prior art photographic papers that contain blue tint materials dispersed in a single thick layer of polyethylene.

The backside of the photographic element is laminated with a biaxially oriented sheet to improve frictional properties for transport in photofinishing equipment and in the case when the digital emulsion is coated on an element that comprises cellulose it reduces humidity induced curl. There are particular problems with prior art resin coated supports when they are subjected to extended high humidity storage such as at greater than 50% relative humidity. The high strength biaxially oriented sheet on the backside resists the curling forces, producing a much flatter image. The biaxially oriented sheet on the back may have roughness at two frequencies to allow for efficient conveyance through photographic processing equipment and improved consumer writability as consumers add personal information to the backside of photographic prints with pens and pencils. The biaxially oriented sheet may also have an energy to break of $4.0\times10^7$ joules per cubic meter to allow for efficient chopping and punching of the photographic element during photographic processing of images.

Because the support materials of the invention are superior to prior art photographic base materials, the support materials utilized in this invention also are superior base materials for digital imaging technology other than silver halide products. By coating digital printing ink or dye receiver layers on the top of the support materials utilized in the invention, image quality and image durability can be improved over prior art materials. Examples of suitable digital imaging ink or dye receiver layer technology include ink jet printing receiver layers, thermal dye transfer receiving layers, and electrophotographic receiving layers.

Suitable biaxially oriented polymer sheets must not interact with the digital light sensitive silver halide imaging layers. Microvoided composite biaxially oriented polymer sheets are preferred and are conveniently manufactured by coextrusion of the core and surface layers, followed by biaxial orientation, whereby voids are formed around void-initiating material contained in the core layer. Such composite sheets are disclosed in U.S. Pat. Nos. 4,377,616; 4,758,462; and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density", is calculated as follows:

$$\frac{\text{Composite Sheet Density}}{\text{Polymer Density}} \times 100 = \%\text{ of Solid Density}$$

Percent solid density should be between 45% and 100%, preferably between 67% and 100%. As the percent solid density becomes less than 67%, the composite sheet becomes less manufacturable due to a drop in tensile strength and it becomes more susceptible to physical damage.

A preferred material is a biaxially oriented polymer sheet that is coated with high barrier polyvinylidene chloride in a range of coverage 1.5 to 6.2 g/m$^2$. Polyvinyl alcohol can also be used but is less effective under high relative humidity conditions. Through the use of at least one of these materials in combination with a biaxially oriented sheet and a polymer tie layer, it has been shown that improved rates of emulsion hardening can be achieved. In said photographic or imaging element, the water vapor barrier can be achieved by integrally forming said vapor barrier by coextrusion of the polymer(s) into at least one or more layers and then orienting the sheet by stretching it in the machine direction and then the cross direction. The process of stretching creates a sheet that is more crystalline and has better packing or alignment of the crystalline areas. Higher levels of crystallinity results in lower oxygen transmissions rates which, in turn, results in more stable prints. In the case when the digital emulsion is used in combination with a cellulose base, the control of water vapor transmission can be provided by any layer independently such as the tie layer or the biaxially oriented polymer sheet or in combination with each other. With the incorporation of other layer(s) that are integrally formed with, applied to, or bonded with the polymer sheet, the water vapor transmission rate can be adjusted to achieve the desired photographic or imaging results.

In a preferred embodiment, the base substrate is a biaxially oriented polymer sheet attached to a polymer substrate such as polyester. Said base then is not subject to problems associated with substrate induced water vapor transmission. One or more of the layers comprising the polymer sheet tie layer combinations may contain $TiO_2$ or other inorganic pigment. In addition, one or more of the layers comprising the biaxially polymer sheet may be voided. Other materials that can be used to enhance the water vapor transmission characteristics comprise at least one material from the group consisting of polyethylene terephthalate, polybutylterephthalate, acetates, cellophane polycarbonates, polyethylene vinyl acetate, ethylene vinyl acetate, methacylate, polyethylene methylacrylate, acrylates, acrylonitrile, polyester ketone, polyethylene acrylic acid, polychlorotrifluoroethylene, polychlorotrifluoroethylene, polytetrafluoroethylene, amorphous nylon, polyhydroxyamide ether, and metal salt of ethylene methacrylic acid copolymers.

An imaging element comprising a base substrate, at least one photosensitive silver halide layer, a layer of biaxially oriented polymer sheet between said base substrate and said silver halide layer, and at least one polymer layer between said biaxially oriented polymer sheet and said base substrate which binds the two together, wherein between the base substrate and the opaque layers of said biaxially oriented sheet, there is located at least one oxygen barrier layer having less than 2.0 cc/m$^2$.hr.atm (20° C., dry state) oxygen transmission is preferred. The terms used herein, "bonding layer", "adhesive layer", and "adhesive" mean the melt extruded resin layer between the biaxially oriented polymer sheets and the base substrate; "oxygen impermeable layer" and "oxygen barrier layer" refer to the layer having oxygen permeability of not more than 2.0 cc/m$^2$·hr.atm according to the method defined in ASTM D-1434-63 when the layer is measured on its own as a discrete sample.

In a preferred embodiment of this invention it has been shown that when an oxygen barrier of at least 2.0 cc/m$^2$ hr. atm. is provided as an integral part of the biaxially oriented sheet, improved fade performance is achieved after exposure to light fade conditions. In a preferred embodiment of this invention, said barrier layer is ethylene vinyl alcohol, and in another more preferred embodiment is polyvinyl alcohol. Additionally it has been shown that the application of an aliphatic polyketone polymer between the emulsion and the photographic base forms an oxygen barrier of about 2.0 cc/m$^2$. It is further demonstrated that an imaging element with an integral layer comprising one member selected from the group consisting of homo- and co-polymers of acrylonitrile, alkyl acrylates such as methyl acrylate, ethyl acrylate, and butyl acrylate, alkyl methacrylates such as methyl methacrylate and ethyl methacrylate, methacrilonitrile, alkyl vinyl esters such as vinyl acetate, vinyl proprionate, vinyl ethyl butyrate and vinyl phenyl acetate, alkyl vinyl ethers such as methyl vinyl ether, butyl vinyl ether and chloroethyl vinyl ether, vinyl alcohol, vinyl chloride, vinylidene chloride, vinyl fluoride, styrene and vinyl acetate (in the case of copolymers, ethylene and/or propylene can be used as comonomers), cellulose acetates such as diacetyl cellulose and triacetyl cellulose, polyesters such as polyethylene terephthalate, a fluorine resin, polyamide (nylon), polycarbonate, polysaccharide, aliphatic polyketone, blue dextran, and cellophane with an oxygen transmission at equal to or less than 2.0 cc/m$^2$ hr. atm. provides improved performance for dye fade.

"Void" is used herein to mean devoid of added solid and liquid matter, although it is likely the "voids" contain gas. The void-initiating particles which remain in the finished packaging sheet core should be from 0.1 to 10 $\mu$m in diameter and preferably round in shape to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The photographic element of this invention generally has a glossy surface, that is, a surface that is sufficiently smooth to provide excellent reflection properties. Prior art photographic paper uses polyethylene cast against a rough chill roll to create nonglossy surfaces. It has been found that by controlling the voiding process in the biaxially oriented sheets, an opalescent surface can be created. An opalescent surface is preferred because it provides a unique photographic appearance to a reflective product that is perceptually preferred by youth, children, and when utilized as an advertising media. The opalescent surface is achieved when the microvoids in the vertical direction are between 1 and 3 μm. By the vertical direction, it is meant the direction that is perpendicular to the plane of the imaging member. The thickness of the microvoids preferably is between 0.7 and 1.5 μm for best physical performance and opalescent properties. The preferred number of microvoids in the vertical direction is between 8 and 30. Less than 6 microvoids in the vertical direction do not create the desired opalescent surface. Greater than 35 microvoids in the vertical direction do not significant improve the optical appearance of the opalescent surface.

The void-initiating material may be selected from a variety of materials and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula $Ar—C(R)=CH_2$, wherein Ar represents an aromatic hydrocarbon radical, or an aromatic halohydrocarbon radical of the benzene series and R is hydrogen or the methyl radical; acrylate-type monomers include monomers of the formula $CH_2=C(R')—C(O)(OR)$ wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2=CH(O)COR$, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terepbthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above-described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate, and mixtures thereof.

Examples of typical monomers for making the cross-linked polymer void initiating particles include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly (methyl methacrylate). Most preferably, it is polystyrene, and the cross-linking agent is divinylbenzene.

Processes well known in the art yield nonuniformly sized void initiating particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes, wherein the agent is added to the suspension, are preferred. As the agent, colloidal silica is preferred.

The void-initiating particles can also be inorganic spheres, including solid or hollow glass spheres, metal or ceramic beads or inorganic particles such as clay, talc, barium sulfate, or calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polymer sheet is utilized.

For the biaxially oriented sheet on the top side toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene, and mixtures thereof. Polyolefin copolymers, including copolymers of propylene and ethylene such as hexene, butene, and octene are also useful. Polypropylene is preferred, as it is low in cost and has desirable strength properties.

The total thickness of the integral emulsion adhesion layer should be between 0.20 μm and 1.5 μm, preferably between 0.5 and 1.0 μm. Below 0.5 μm any inherent nonplanarity in the coextruded skin layer may result in unacceptable color variation. At skin thickness greater than 1.0 μm, there is a reduction in the photographic optical properties such as image resolution. At thickness greater than 1.0 μm, there is also a greater material volume to filter for contamination such as clumps or poor color pigment dispersion.

Addenda may be added to the topmost skin layer to change the color of the imaging element. For photographic use, a white base with a slight bluish tinge is preferred. The addition of the slight bluish tinge may be accomplished by any process which is known in the art including the machine blending of color concentrate prior to extrusion and the melt extrusion of blue colorants that have been preblended at the desired blend ratio. Colored pigments that can resist extrusion temperatures greater than 320° C. are preferred, as temperatures greater than 320° C. are necessary for coextrusion of the skin layer. Blue colorants used in this invention may be any colorant that does not have an adverse impact on the imaging element. Preferred blue colorants include Phthalocyanine blue pigments, Cromophtal blue pigments, Irgazin blue pigments, and Irgalite organic blue pigments. Optical brightener may also be added to the skin layer to absorb UV energy and emit light largely in the blue region. $TiO_2$ may also be added to the skin layer, although this is not preferred. While the addition of $TiO_2$ in the thin skin layer of this invention does not significantly contribute to the optical performance of the sheet, it can cause numerous manufacturing problems such as extrusion die lines and spots. The skin layer substantially free of $TiO_2$ is preferred. $TiO_2$ added to a layer between 0.20 and 1.5 $\mu$m does not substantially improve the optical properties of the support, will add cost to the design, and will cause objectionable pigments lines in the extrusion process.

Addenda may be added to the core matrix and/or to one or more skin layers to improve the optical properties of the photographic support. Titanium dioxide is preferred and is used in this invention to improve image sharpness or MTF, opacity, and whiteness. The $TiO_2$ used may be either anatase or rutile type. Further, both anatase and rutile $TiO_2$ may be blended to improve both whiteness and sharpness. Examples of $TiO_2$ that are acceptable for a photographic system are DuPont Chemical Co. R101 rutile $TiO_2$ and DuPont Chemical Co. R104 rutile $TiO_2$. Other pigments known in the art to improve photographic optical responses may also be used in this invention. Examples of other pigments known in the art to improve whiteness are talc, kaolin, $CaCO_3$, $BaSO_4$, ZnO, $TiO_2$, ZnS, and $MgCO_3$. The preferred $TiO_2$ type is anatase, as anatase $TiO_2$ has been found to optimize image whiteness and sharpness with a voided layer.

The preferred weight percent of white pigment to be added to the biaxially oriented layers between the photosensitive layer and the voided layer for a reflective base can range from 18% to 24%. Below 15% the optical properties of the voided biaxially oriented sheet do not show a significant improvement over prior art resin coated photographic media. Above 28%, manufacturing problems such as unwanted voiding and a loss of coating speed are encountered. The voided layer may also contain white pigments. The voided layer may contain between 2 and 18% white pigment, preferably between 2% and 8%. Below 2%, the optical properties of the voided biaxially oriented sheet do not show a significant improvement. Above 8%, the voided layer suffers from a loss in mechanical strength which will reduce the commercial value of the photographic support of this invention as images are handled and viewed by consumers.

The layer adjacent and below the voided layer may also contain white pigments of this invention. A layer that is substantially colorant free is preferred, as there is little improvement in the optical performance of the photographic support when colorants are added below the voided layer. The preferred weight percent of white pigment to be added to the biaxially oriented layer below the voided layer can range from 12% to 24%. Below 8% the optical properties of the voided biaxially oriented sheet do not show a significant improvement over prior art photographic paper. Above 28%, manufacturing problems such as unwanted voiding, loss of coating speed, and poor $TiO_2$ dispersions are encountered.

Addenda may be added to the biaxially oriented sheet of this invention so that when the biaxially oriented sheet is viewed from a surface, the imaging element emits light in the visible spectrum when exposed to ultraviolet radiation. Emission of light in the visible spectrum allows for the support to have a desired background color in the presence of ultraviolet energy. This is particularly useful when images are viewed outside as sunlight contains ultraviolet energy and may be used to optimize image quality for consumer and commercial applications.

Addenda known in the art to emit visible light in the blue spectrum are preferred. Consumers generally prefer a slight blue tint to the density minimum areas of a developed image defined as a negative b* compared to a neutral density minimum defined as a b* within one b* unit of zero. b* is the measure of yellow/blue in CIE (Commission Internationale de L'Eclairage) space. A positive b* indicates yellow, while a negative b* indicates blue. The addition of addenda that emits in the blue spectrum allows for tinting the support without the addition of colorants which would decrease the whiteness of the image. The preferred emission is between 1 and 5 delta b* units. Delta b* is defined as the b* difference measured when a sample is illuminated with a ultraviolet light source and a light source without any significant ultraviolet energy. Delta b* is the preferred measure to determine the net effect of adding an optical brightener to the top biaxially oriented sheet of this invention. Emissions less than 1 b* unit cannot be noticed by most customers; therefore, is it not cost effective to add optical brightener to the biaxially oriented sheet when the b* is changed by less than 1 b* unit. An emission greater that 5 b* units would interfere with the color balance of the images making the whites appear too blue for most consumers.

The preferred addenda of this invention is an optical brightener. An optical brightener is a colorless, fluorescent, organic compound that absorbs ultraviolet light and emits it as visible blue light. Examples include, but are not limited to, derivatives of 4,4'-diaminostilbene-2,2'-disulfonic acid, coumarin derivatives such as 4-methyl-7-diethylaminocoumarin, 1-4-Bis(O-Cyanostyryl) Benzol and 2-Amino4-Methyl Phenol.

Layers below the exposed surface layer in biaxially oriented sheet of the invention may also contain pigments which are known to improve the photographic optical responses such as whiteness or sharpness. Titanium dioxide is used in this invention to improve image sharpness, whiteness, and provide the required level of opacity to the biaxially oriented sheets. The $TiO_2$ used may be either anatase or rutile type. For this invention, rutile is the preferred because the unique particle size and geometry optimize image quality for most consumer applications. Examples of rutile $TiO_2$ that are acceptable for a photographic system are DuPont Chemical Co. R101 rutile $TiO_2$ and DuPont Chemical Co. R104 rutile $TiO_2$. Other pigments to improve image quality may also be used in this invention.

The present invention in a preferred embodiment consists of a multilayer film of biaxially oriented polymer which is attached to both the top and bottom of a photographic quality polyester support by melt extrusion of a polymer tie layer. A room temperature adhesive may also be used. The biaxially oriented films that have been used in this invention contain a plurality of layers in which at least one of the layers contains voids. The voids provide added opacity to the imaging element. This voided layer can also be used in conjunction with a layer that contains at least one pigment from the group consisting of $TiO_2$, $CaCO_3$, clay, $BaSO_4$, ZnS, $MgCO_3$, talc, kaolin, or other materials that provide a highly reflective white layer in said film of more than one layer. The combination of a pigmented layer with a voided layer provides advantages in the reflection performance of the final image.

Voided layers are more susceptible than solid layers to mechanical failure, such as cracking or delamination from adjacent layers. Voided structures that contain $TiO_2$, or are in proximity to layers containing $TiO_2$, are particularly susceptible to loss of mechanical properties and mechanical failure with long-term exposure to light. $TiO_2$ particles initiate and accelerate the photooxidative degradation of polypropylene. The addition of a hindered amine stabilizer to at least one layer of a multilayer biaxially oriented film and in the preferred embodiment in the layers containing $TiO_2$ and, furthermore, in the most preferred embodiment the hindered amine is in the layer with $TiO_2$, as well as in the adjacent layers, that improvements to both light and dark keeping image stability are achieved.

The film preferably contains a stabilizing amount of hindered amine at or about 0.01 to 5% by weight in at least one layer of said film. While these levels provide improved stability to the biaxially oriented film, the preferred amount at or about 0.1 to 3% by weight provides an excellent balance between improved stability for both light and dark keeping, while making the structure more cost effective.

The hindered amine light stabilizer (HALS) may come from the common group of hindered amine compounds originating from 2,2,6,6-tetramethylpiperidine, and the term hindered amine light stabilizer is accepted to be used for hindered piperidine analogs. The compounds form stable nitroxyl radicals that interfere with photooxidation of polypropylene in the presence of oxygen, thereby affording excellent long-term photographic stability of the imaging element. The hindered amine will have sufficient molar mass to minimize migration in the final product, will be miscible with polypropylene at the preferred concentrations, and will not impart color to the final product. In the preferred embodiment, examples of HALS include poly{[6-[(1,1,3,3-tetramethylbutylamino}-1,3,5-triazine-4-piperidinyl)-imino]-1,6-hexanediyl[(2,2,6,6-tetramethyl-4-piperdinyl) imino)]} (Chimassorb 944 LD/FL), Chimassorb 119, and bis(1,2,2,6,6-pentamethyl-4-piperidinyl)[3,5-bis(1,1-dimethylethyl-4-hydroxyphenyl)methyl]butylpropanedioate (Tinuvin 144), although they are not limited to these compounds.

In addition, the film may contain any of the hindered phenol primary antioxidants commonly used for thermal stabilization of polypropylene, alone, or in combination with a secondary antioxidants. Examples of hindered phenol primary antioxidants include pentaerythrityl tetrakis [3-(3,5-di-tert-butyl-4-hydroxyphenyl)proprionate] (such as Irganox 1010), octadecyl 3-(3,5-di-tert-butyl-4-hydroxyphenyl) proprionate (such as Irganox 1076), benzenepropanoic acid 3,5-bis(1,1-dimethyl)-4-hydroxy-2[3-[3,5-bis(1,1-dimethylethyl)-4-hydroxyphenyl)-1-oxopropyl)hydrazide (such as Irganox MD1024), 2,2'-thiodiethylenebis[3-(3,5-di-tert-butyl-4-hydroxyphenyl)proprionate] (such as Irganox 1035), 1,3,5-trimethyl-2,4,6-tri(3,5-di-tert-butyl-4-hydroxybenzyl)-benzene (such as Irganox 1330), but are not limited to these examples. Secondary antioxidants include organic alkyl and aryl phosphites including examples such as triphenylphosphite (such as Irgastab TPP), tri(n-propylphenyl-phophite) (such as Irgastab SN-55), 2,4-bis(1,1-dimethylphenyl) phosphite (such as Irgafos 168), and in a preferred embodiment would include Irgafos 168. The combination of hindered amines with other primary and secondary antioxidants have a synergistic benefit in a multilayer biaxially oriented polymer sheet by providing thermal stability to polymers such as polypropylene during melt processing and extrusion, and further enhancing their light and dark keeping properties which is not evident in a mono layer system for imaging products such as photographs. These unexpected results provide for a broader range of polymers that can be utilized in imaging product, thus enabling enhanced features to be incorporated into their design.

When the desired weight percentage loading of the optical brightener begins to approach a concentration at which the optical brightener migrates to the surface of the support forming crystals in the imaging layer, the addition of optical brightener into the layer adjacent to the exposed layer is preferred. In prior art imaging supports that use optical brightener, expensive grades of optical brightener are used to prevent migration into the imaging layer. When optical brightener migration is a concern, as with light sensitive silver halide imaging systems, the preferred exposed layer comprises polyethylene that is substantially free of optical brightener. In this case, the migration from the layer adjacent to the exposed layer is significantly reduced because the exposed surface layer acts as a barrier for optical brightener migration allowing for much higher optical brightener levels to be used to optimize image quality. Further, locating the optical brightener in the layer adjacent to the exposed layer allows for a less expensive optical brightener to be used as the exposed layer, which is substantially free of optical brightener, prevents significant migration of the optical brightener. Another preferred method to reduce unwanted optical brightener migration in biaxially oriented sheets of this invention is to use polypropylene for the layer adjacent to the exposed surface. Prior art photographic supports generally use melt extruded polyethylene to provide waterproofing to the base paper. Since optical brightener is more soluble in polypropylene than polyethylene, the optical brightener is less likely to migrate from polypropylene to the exposed surface layer.

A biaxially oriented sheet of this invention which has a microvoided core is preferred. The microvoided core adds opacity and whiteness to the imaging support, further improving imaging quality. Combining the image quality advantages of a microvoided core with a material, which absorbs ultraviolet energy and emits light in the visible spectrum, allows for the unique optimization of image quality, as the image support can have a tint when exposed to ultraviolet energy yet retain excellent whiteness when the image is viewed using lighting that does not contain significant amounts of ultraviolet energy such as indoor lighting.

It has been found that the microvoids located in the voided layer of the top biaxially oriented sheet provide a reduction in undesirable pressure fog. Mechanical pressure, of the order of hundreds of kilograms per square centimeter, causes an undesirable, reversible decrease in sensitivity by a mechanism at the time of writing that is not fully understood. The net result of mechanical pressure is an unwanted increase in density, mainly yellow density. The voided layer in the biaxially oriented sheet absorbs mechanical pressure by compression of the voided layer, common in the converting and photographic processing steps, and reduces the amount of yellow density change. Pressure sensitivity is measured by applying a 206 MPa load to the coated light sensitive silver halide emulsion, developing the yellow layer, and measuring the density difference with an X-Rite model 310 (or comparable) photographic transmission densitometer between the control sample which was unloaded and the loaded sample. The preferred change in yellow layer density is less than 0.02 at a pressure of 206 MPa. A 0.04 change in yellow density is perceptually significant and, thus, undesirable.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature and below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers, while restraining to some degree the sheet against retraction in both directions of stretching.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

By having at least one nonvoided skin on the microvoided core, the tensile strength of the sheet is increased and makes the sheet more manufacturable. The higher tensile strength also allows the sheets to be made at wider widths and higher draw ratios than when sheets are made with all layers voided. Coextruding the layers further simplifies the manufacturing process.

A substantially transparent magnetic recording layer may be applied to the bottom biaxially oriented polymer sheet. A magnetic recording layer can be used to record photographic processing information such as date and time of processing, voice or data from the capture device, or can be used to store a digital file of the printed image. By "substantially transparent" it is meant that the magnetic particles are sufficiently dispersed and are of a size and distribution to permit substantial transmittance, greater than 60% of visible light, through the magnetic recording layer. More specifically, the substantially transparent magnetic recording layer increases the optical density of the backside biaxially oriented sheet by less than 0.2 optical density units across the visible portion of the spectrum from 400 nm to 700 nm.

In forming the transparent magnetic recording layer, magnetic particles with a surface area of 30 $m^2$/gram are applied in a coated layer having a dried thickness less than 1.5 $\mu$m. The magnetic particles are homogeneously dispersed in a transparent binder and a solvent for the binder. An example of a magnetic binder is cellulose organic acid esters. Suitable solvents include methylene chloride, methyl alcohol, methyl ethyl ketone, methyl isobutyl ketone, ethyl acetate, butyl acetate, cyclohexanone, butyl alcohol, and mixtures thereof. The dispersing medium can also contain transparent addenda such as plasticizers and dispersing agents.

Since for many product application, the biaxially oriented polymer sheet of the invention does not have the desired mechanical stiffness required for photoprocessing, consumer handling or commercial image display, the biaxially oriented polymer sheet needs to be adhered to a stiff base material. The support material or base material to which the microvoided composite sheets and biaxially oriented sheets are laminated for the laminated support of the photosensitive silver halide layer may be a polymeric substrate, synthetic paper, cloth, woven polymer fibers, or a cellulose fiber paper support, or laminates thereof. A preferred support is a photographic grade polyester base as the polyester base material provides the required stiffness for commercial display. Another preferred base material is cellulose paper. Because cellulose paper is strong and low in cost, it is an ideal material for consumer images.

The bonding agent used for bonding biaxially oriented sheets to polyester is preferably selected from a group of resins that can be melt extruded at about 160° C. to 300° C. Usually, a modified olefin copolymer such as anhydride-modified ethylene acrylate or polyethylene methylacrylate, ethylacrylate and others.

Adhesive resins are preferred for bonding biaxially oriented sheets to polyester. An adhesive resin used in this invention is one that can be melt extruded or applied at room temperature and provide sufficient bond strength between the polyester and the biaxially oriented sheet. For use in the conventional photographic system, peel forces between the polyester and the biaxially oriented sheets need to be greater than 150 grams/5 cm to prevent delamination during the manufacture of the photographic base, during processing of an image, or in the final image format. "Peel strength" or "separation force" or "peel force" is the measure of the amount of force required to separate the biaxially oriented sheets from the base paper. Peel strength is measured using an Instron gauge and the 180 degree peel test with a cross head speed of 1.0 meters/min. The sample width is 5 cm and the distance peeled is 10 cm.

In the case of a silver halide photographic system, suitable adhesive resins must also not interact with the light sensitive emulsion layer. Preferred examples of adhesive resins are ionomer (e.g., an ethylene metharylic acid copolymer cross linked by metal ions such as Na ions or Zn ions), ethylene vinyl acetate copolymer, ethylene methyl methacrylate copolymer, ethylene ethyl acrylate copolymer, ethylene methyl acrylate copolymer, ethylene acrylic acid copolymer, ethylene ethyl acrylate maleic anhydride copolymer, or ethylene methacrylic acid copolymer. These adhesive resins are preferred because they can be easily melt extruded and provide peel forces between biaxially oriented polyolefin sheets and base paper greater than 150 grams/5 cm.

Metallocene catalyzed polyolefin plastomers are most preferred for bonding oriented polyolefin sheets to photographic cellulose base because they offer a combination of excellent adhesion to smooth biaxially oriented polyolefin sheets, are easily melt extruded using conventional extrusion equipment, and are low in cost when compared to other adhesive resins. Metallocenes are class of highly active olefin catalysts that are used in the preparation of polyolefin plastomers. These catalysts, particularly those based on group IVB transition metals such as zirconium, titanium, and hafnium, show extremely high activity in ethylene polymerization. Various forms of the catalyst system of the metallocene type may be used for polymerization to prepare the polymers used for bonding biaxially oriented polyolefin sheets to cellulose paper. Forms of the catalyst system include, but are not limited to, those of homogeneous, supported catalyst type, high pressure process or a slurry or a solution polymerization process. The metallocene catalysts are also highly flexible in that, by manipulation of catalyst composition and reaction conditions, they can be made to provide polyolefins with controllable molecular weights. Suitable polyolefins include polypropylene, polyethylene, polymethylpentene, polystyrene, polybutylene, and mixtures thereof. Development of these metallocene catalysts for the polymerization of ethylene is found in U.S. Pat. No. 4,937,299 (Ewen et al).

The bonding layer may also contain pigments which are known to improve the photographic responses such as whiteness or sharpness. Titanium dioxide is preferred and used in this invention to improve image sharpness. The $TiO_2$ used may be either anatase or rutile type. In the case of whiteness, anatase is the preferred type. In the case of sharpness, rutile is the preferred. Further, both anatase and rutile $TiO_2$ may be blended to improve both whiteness and sharpness. Examples of $TiO_2$ that are acceptable for a photographic system are DuPont Chemical Co. R101 rutile $TiO_2$ and DuPont Chemical Co. R104 rutile $TiO_2$. Other pigments to improve photographic responses may also be used in this invention. Examples of other white pigments include talc, kaolin, $CaCO_3$, $BaSO_4$, ZnO, $TiO_2$, ZnS, and $MgCO_3$. The preferred weigh percent of $TiO_2$ added to the bonding layer is between 12% and 18%. The addition of $TiO_2$ less than 8% does not significantly impact the optical performance of the image. $TiO_2$ greater than 24% decreases manufacturing efficiency, as problems such as extrusion pigment die lines are encountered.

The bonding layer may also contain addenda known in the art to absorb light. A light absorbing layer in this invention is used to improve optical properties of an image, properties such as opacity and image resolution. An example of a light absorbing material that can be added to the bonding layer is an extrusion grade of carbon black. Carbon black addenda are produced by the controlled combustion of liquid hydrocarbons and can be added to the bonding layer prior to melt extrusion.

In the manufacturing process for this invention, preferred bonding agents are melt extruded from a slit die. In general, a T die or a coat hanger die are preferably used. The melt temperature of the preferred bonding agent is 240° C. to 325° C. Extrusion lamination is carried out by bringing together the biaxially oriented sheet and the base substrate with application of the bonding agent between the base substrate and the biaxially oriented sheet followed by their being pressed together in a nip such as between two rollers. The total thickness of the bonding layer can range from 2.5 μm to 25 μm, preferably from 3.8 μm to 13 μm. Below 3.8 μm it is difficult to maintain a consistent melt extruded bonding layer thickness.

The structure of a preferred reflective base material utilizing a five layer biaxially oriented sheet of the invention on the top and a mono layer biaxially oriented polypropylene sheet on the bottom where the digital emulsion is applied to the polyethylene exposed layer is as follows. This base material is an ideal digital consumer print material.

Polyethylene exposed surface layer with blue tint
Polypropylene layer containing 24% anatase $TiO_2$, optical brightener and HALS
Polypropylene microvoided layer with 0.55 grams per cubic cm density
Polypropylene layer with 18% anatase $TiO_2$ and HALS
Polypropylene bottom layer
Polyethylene
Cellulose paper base
Polyethylene
Polypropylene The structure of another preferred composite base support material where the digital photosensitive imaging layers are coated on the exposed polyethylene layer is as follows. The first five layer are provided as a integral biaxially oriented polymer sheet. The top sheet is laminated to the polyester base with a polyethylene methylacrylate adhesive layer. The bottom sheet is a two layer biaxially oriented polymer sheet that has an antistatic coating applied. This base material can function as a transmission commercial display material.

Polyethylene exposed top surface layer with blue and red tint
Polypropylene layer containing 4% anatase $TiO_2$ and HALS
Polypropylene microvoided layer with 0.55 grams per cubic cm density
Polypropylene layer
Copolymer blend of polyolefin and anhydride modified ethylene acrylate
Polyethylene Methylacrylate adhesive layer
Polyester Base 4 mils thick
Polyethylene Methylacrylate adhesive layer
Solid polypropylene core
Mixture of polypropylenes and a terpolymer of ethylene-propylene-butylene
Styrene butadiene methacrylate coating with semiconductive metal oxide Disclosed below are preferred digital silver halide imaging layers. The digital silver halide imaging layers are applied to the biaxially oriented polymer base material. This invention is directed to a silver halide photographic element capable of excellent performance when exposed by either an electronic printing method or a conventional optical printing method. An electronic printing method comprises subjecting a radiation sensitive silver halide emulsion layer of a recording element to actinic radiation of at least $10^{-4}$ ergs/cm$^2$ for up to 100μ seconds duration in a pixel-by-pixel mode wherein the silver halide emulsion layer is comprised of silver halide grains as described above. A conventional optical printing method comprises subjecting a radiation sensitive silver halide emulsion layer of a recording element to actinic radiation of at least $10^{-4}$ ergs/cm$^2$ for $10^{-3}$ to 300 seconds in an imagewise mode wherein the silver halide emulsion layer is comprised of silver halide grains as described above.

This invention in a preferred embodiment utilizes a radiation-sensitive emulsion comprised of silver halide grains (a) containing greater than 50 mole percent chloride, based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula $$[ML_6]^n \quad \text{(I)}$$

wherein n is zero, −1, −2, −3 or −4; M is a filled frontier orbital polyvalent metal ion, other than iridium; and $L_6$ represents bridging ligands which can be independently selected, provided that least four of the ligands are anionic ligands, and at least one of the ligands is a cyano ligand or a ligand more electronegative than a cyano ligand; and (ii) an iridium coordination complex containing a thiazole or substituted thiazole ligand.

This invention is directed towards a photographic recording element comprising a support and at least one light sensitive silver halide emulsion layer comprising silver halide grains as described above.

It has been discovered quite surprisingly that the combination of dopants (i) and (ii) provides greater reduction in reciprocity law failure than can be achieved with either dopant alone. Further, unexpectedly, the combination of dopants (i) and (ii) achieve reductions in reciprocity law failure beyond the simple additive sum achieved when employing either dopant class by itself. It has not been reported or suggested prior to this invention that the combination of dopants (i) and (ii) provides greater reduction in reciprocity law failure, particularly for high intensity and short duration exposures. The combination of dopants (i) and (ii) further unexpectedly achieves high intensity reciprocity with iridium at relatively low levels, and both high and low intensity reciprocity improvements even while using conventional gelatino-peptizer (e.g., other than low methionine gelatino-peptizer).

In a preferred practical application, the advantages of the invention can be transformed into increased throughput of digital substantially artifact-free color print images while exposing each pixel sequentially in synchronism with the digital data from an image processor.

In one embodiment, the present invention represents an improvement on the electronic printing method. Specifically, this invention in one embodiment is directed to an electronic printing method which comprises subjecting a radiation sensitive silver halide emulsion layer of a recording element to actinic radiation of at least $10^{-4}$ ergs/cm$^2$ for up to 100$\mu$ seconds duration in a pixel-by-pixel mode. The present invention realizes an improvement in reciprocity failure by selection of the radiation sensitive silver halide emulsion layer. While certain embodiments of the invention are specifically directed towards electronic printing, use of the emulsions and elements of the invention is not limited to such specific embodiment, and it is specifically contemplated that the emulsions and elements of the invention are also well suited for conventional optical printing.

It has been unexpectedly discovered that significantly improved reciprocity performance can be obtained for silver halide grains (a) containing greater than 50 mole percent chloride, based on silver, and (b) having greater than 50 percent of their surface area provided by {100} crystal faces by employing a hexacoordination complex dopant of class (i) in combination with an iridium complex dopant comprising a thiazole or substituted thiazole ligand. The reciprocity improvement is obtained for silver halide grains employing conventional gelatino-peptizer, unlike the contrast improvement described for the combination of dopants set forth in U.S. Pat. Nos. 5,783,373 and 5,783,378, which requires the use of low methionine gelatino-peptizers as discussed therein, and which states it is preferable to limit the concentration of any gelatino-peptizer with a methionine level of greater than 30 micromoles per gram to a concentration of less than 1 percent of the total peptizer employed. Accordingly, in specific embodiments of the invention, it is specifically contemplated to use significant levels (i.e., greater than 1 weight percent of total peptizer) of conventional gelatin (e.g., gelatin having at least 30 micromoles of methionine per gram) as a gelatino-peptizer for the silver halide grains of the emulsions of the invention. In preferred embodiments of the invention, gelatino-peptizer is employed which comprises at least 50 weight percent of gelatin containing at least 30 micromoles of methionine per gram, as it is frequently desirable to limit the level of oxidized low methionine gelatin which may be used for cost and certain performance reasons.

In a specific, preferred form of the invention it is contemplated to employ a class (i) hexacoordination complex dopant satisfying the formula:

$$[ML_6]^n \quad (I)$$

where n is zero, −1, −2, −3 or −4;

M is a filled frontier orbital polyvalent metal ion, other than iridium, preferably $Fe^{+2}$, $Ru^{+2}$, $Os^{+2}$, $Co^{+3}$, $Rh^{+3}$, $Pd^{+4}$ or $Pt^{+4}$, more preferably an iron, ruthenium or osmium ion, and most preferably a ruthenium ion;

$L_6$ represents six bridging ligands which can be independently selected, provided that least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands, including aquo ligands, halide ligands (specifically, fluoride, chloride, bromide and iodide), cyanate ligands, thiocyanate ligands, selenocyanate ligands, tellurocyanate ligands, and azide ligands. Hexacoordinated transition metal complexes of class (i) which include six cyano ligands are specifically preferred.

Illustrations of specifically contemplated class (i) hexacoordination complexes for inclusion in the high chloride grains are provided by Olm et al U.S. Pat. No. 5,503,970 and Daubendiek et al U.S. Pat. Nos. 5,494,789 and 5,503,971, and Keevert et al U.S. Pat. No. 4,945,035, as well as Murakami et al Japanese Patent Application Hei-2[1990]-249588, and Research Disclosure Item 36736. Useful neutral and anionic organic ligands for class (ii) dopant hexacoordination complexes are disclosed by Olm et al U.S. Pat. No. 5,360,712 and Kuromoto et al U.S. Pat. No. 5,462,849.

Class (i) dopant is preferably introduced into the high chloride grains after at least 50 (most preferably 75 and optimally 80) percent of the silver has been precipitated, but before precipitation of the central portion of the grains has been completed. Preferably class (i) dopant is introduced before 98 (most preferably 95 and optimally 90) percent of the silver has been precipitated. Stated in terms of the fully precipitated grain structure, class (i) dopant is preferably present in an interior shell region that surrounds at least 50 (most preferably 75 and optimally 80) percent of the silver and, with the more centrally located silver, accounts the entire central portion (99 percent of the silver), most preferably accounts for 95 percent, and optimally accounts for 90 percent of the silver halide forming the high chloride grains. The class (i) dopant can be distributed throughout the interior shell region delimited above or can be added as one or more bands within the interior shell region.

Class (i) dopant can be employed in any conventional useful concentration. A preferred concentration range is from $10^{-8}$ to $10^{-3}$ mole per silver mole, most preferably from $10^{-6}$ to $5\times10^{-4}$ A mole per silver mole.

The following are specific illustrations of class (i) dopants:

(i-1) $[Fe(CN)_6]^{-4}$
(i-2) $[Ru(CN)_6]^{-4}$
(i-3) $[Os(CN)_6]^{-4}$
(i-4) $[Rh(CN)_6]^{-3}$
(i-5) $[Co(CN)_6]^{-3}$
(i-6) $[Fe(pyrazine)(CN)_5]^{-4}$
(i-7) $[RuCl(CN)_5]^{-4}$
(i-8) $[OsBr(CN)_5]^{-4}$
(i-9) $[RhF(CN)_5]^{-3}$
(i-10) $[In(NCS)_6]^{-3}$
(i-11) $[FeCO(CN)_5]^{-3}$
(i-12) $[RuF_2(CN)_4]^{-4}$
(i-13) $[OsCl_2(CN)_4]^{-4}$
(i-14) $[RhI_2(CN)_4]^{-3}$
(i-15) $[Ga(NCS)_6]^{-3}$
(i-16) $[Ru(CN)_5(OCN)]^{-4}$ (i-17) $[Ru(CN)_5(N_3)]^{-4}$ (i-18) $[Os(CN)_5(SCN)]^{-4}$ (i-19) $[Rh(CN)_5(SeCN)]^{-3}$ (i-20) $[Os(CN)Cl_5]^{-4}$ (i-21) $[Fe(CN)_3Cl_3]^{-3}$ (i-22) $[Ru(CO)_2(CN)_4]^{-1}$ When the class (i) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. It is noted that the same comments apply to class (ii) dopants, otherwise described below.

The class (ii) dopant is an iridium coordination complex containing at least one thiazole or substituted thiazole ligand. Careful scientific investigations have revealed Group VIII hexahalo coordination complexes to create deep electron traps, as illustrated R. S. Eachus, R. E. Graves and M. T. Olm *J. Chem. Phys.,* Vol. 69, pp. 4580–7 (1978) and *Physica Status Solidi A,* Vol. 57, 429–37 (1980) and R. S. Eachus and M. T. Olm *Annu. Rep. Prog. Chem. Sect. C. Phys. Chem.,* Vol. 83, 3, pp. 3–48 (1986). The class (ii) dopants employed in the practice of this invention are believed to create such deep electron traps. The thiazole ligands may be substituted with any photographically acceptable substituent which does not prevent incorporation of the dopant into the silver halide grain. Exemplary substituents include lower alkyl (e.g., alkyl groups containing 1–4 carbon atoms), and specifically methyl. A specific example of a substituted thiazole ligand which may be used in accordance with the invention is 5-methylthiazole. The class (ii) dopant preferably is an iridium coordination complex having ligands each of which are more electropositive than a cyano ligand. In a specifically preferred form the remaining non-thiazole or non-substituted-thiazole ligands of the coordination complexes forming class (ii) dopants are halide ligands.

It is specifically contemplated to select class (ii) dopants from among the coordination complexes containing organic ligands disclosed by Olm et al U.S. Pat. No. 5,360,712, Olm et al U.S. Pat. No. 5,457,021 and Kuromoto et al U.S. Pat. No. 5,462,849.

In a preferred form it is contemplated to employ as a class (ii) dopant a hexacoordination complex satisfying the formula:

$$[IrL^1_6]^{n'} \quad \text{(II)}$$

wherein n' is zero, −1, −2, −3 or −4; and $L^1_6$ represents six bridging ligands which can be independently selected, provided that at least four of the ligands are anionic ligands, each of the ligands is more electropositive than a cyano ligand, and at least one of the ligands comprises a thiazole or substituted thiazole ligand. In a specifically preferred form at least four of the ligands are halide ligands, such as chloride or bromide ligands.

Class (ii) dopant is preferably introduced into the high chloride grains after at least 50 (most preferably 85 and optimally 90) percent of the silver has been precipitated, but before precipitation of the central portion of the grains has been completed. Preferably class (ii) dopant is introduced before 99 (most preferably 97 and optimally 95) percent of the silver has been precipitated. Stated in terms of the fully precipitated grain structure, class (ii) dopant is preferably present in an interior shell region that surrounds at least 50 (most preferably 85 and optimally 90) percent of the silver and, with the more centrally located silver, accounts the entire central portion (99 percent of the silver), most preferably accounts for 97 percent, and optimally accounts for 95 percent of the silver halide forming the high chloride grains. The class (ii) dopant can be distributed throughout the interior shell region delimited above or can be added as one or more bands within the interior shell region.

Class (ii) dopant can be employed in any conventional useful concentration. A preferred concentration range is from $10^{-9}$ to $10^{-4}$ mole per silver mole. Iridium is most preferably employed in a concentration range of from $10^{-8}$ to $10^{-5}$ mole per silver mole.

Specific illustrations of class (ii) dopants are the following:

(ii-1) $[IrCl_5(\text{thiazole})]^{-2}$ (ii-2) $[IrCl_4(\text{thiazole})_2]^{-1}$ (ii-3) $[IrBr_5(\text{thiazole})]^{-2}$ (ii-4) $[IrBr_4(\text{thiazole})_2]^{-1}$ (ii-5) $[IrCl_5(\text{5-methylthiazole})]^{-2}$ (ii-6) $[IrCl_4(\text{5-methylthiazole})_2]^{-1}$ (ii-7) $[IrBr_5(\text{5-methylthiazole})]^{-2}$ (ii-8) $[IrBr_4(\text{5-methylthiazole})_2]_{-1}$ In one preferred aspect of the invention in a layer using a magenta dye forming coupler, a class (ii) dopant in combination with an $OsCl_5(NO)$ dopant has been found to produce a preferred result.

Emulsions demonstrating the advantages of the invention can be realized by modifying the precipitation of conventional high chloride silver halide grains having predominantly (>50%) {100} crystal faces by employing a combination of class (i) and (ii) dopants as described above.

The silver halide grains precipitated contain greater than 50 mole percent chloride, based on silver. Preferably the grains contain at least 70 mole percent chloride and, optimally at least 90 mole percent chloride, based on silver. Iodide can be present in the grains up to its solubility limit, which is in silver iodochloride grains, under typical conditions of precipitation, about 11 mole percent, based on silver. It is preferred for most photographic applications to limit iodide to less than 5 mole percent iodide, most preferably less than 2 mole percent iodide, based on silver.

Silver bromide and silver chloride are miscible in all proportions. Hence, any portion, up to 50 mole percent, of the total halide not accounted for chloride and iodide, can be bromide. For color reflection print (i.e., color paper) uses bromide is typically limited to less than 10 mole percent based on silver and iodide is limited to less than 1 mole percent based on silver.

In a widely used form high chloride grains are precipitated to form cubic grains—that is, grains having {100} major faces and edges of equal length. In practice ripening effects usually round the edges and corners of the grains to some extent. However, except under extreme ripening conditions substantially more than 50 percent of total grain surface area is accounted for by {100} crystal faces.

High chloride tetradecahedral grains are a common variant of cubic grains. These grains contain 6 {100} crystal faces and 8 {111} crystal faces. Tetradecahedral grains are within the contemplation of this invention to the extent that greater than 50 percent of total surface area is accounted for by {100} crystal faces.

Although it is common practice to avoid or minimize the incorporation of iodide into high chloride grains employed in color paper, it is has been recently observed that silver iodochloride grains with {100} crystal faces and, in some instances, one or more {111} faces offer exceptional levels of photographic speed. In the these emulsions iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0 718 679.

In another improved form the high chloride grains can take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least >8). Tabular grains typically have thicknesses of less than 0.3 $\mu$m, preferably less than 0.2 $\mu$m, and optimally less than 0.07 $\mu$m. High chloride {100} tabular grain emulsions and their preparation are disclosed by Maskasky U.S. Pat. Nos. 5,264,337 and 5,292,632; House et al U.S. Pat. No. 5,320,938; Brust et al U.S. Pat. No. 5,314,798; and Chang et al U.S. Pat. No. 5,413,904.

Once high chloride grains having predominantly {100} crystal faces have been precipitated with a combination of class (i) and class (ii) dopants described above, chemical and spectral sensitization, followed by the addition of conventional addenda to adapt the emulsion for the imaging application of choice can take any convenient conventional form. These conventional features are illustrated by Research Disclosure, Item 38957, cited above, particularly:

III. Emulsion washing;
IV. Chemical sensitization;
V. Spectral sensitization and desensitization;
VII. Antifoggants and stabilizers;
VIII. Absorbing and scattering materials;
IX. Coating and physical property modifying addenda; and
X. Dye image and modifiers.

Some additional silver halide, typically less than 1 percent, based on total silver, can be introduced to facilitate chemical sensitization. It is also recognized that silver halide can be epitaxially deposited at selected sites on a host grain to increase its sensitivity. For example, high chloride {100} tabular grains with corner are illustrated by Maskasky U.S. Pat. No. 5,275,930. For the purpose of providing a clear demarcation, the term "silver halide grain" is herein employed to include the silver necessary to form the grain up to the point that the final {100} crystal faces of the grain are formed. Silver halide later deposited that does not overlie the {100} crystal faces previously formed accounting for at least 50 percent of the grain surface area is excluded in determining total silver forming the silver halide grains. Thus, the silver forming selected site epitaxy is not part of the silver halide grains while silver halide that deposits and provides the final {100} crystal faces of the grains is included in the total silver forming the grains, even when it differs significantly in composition from the previously precipitated silver halide.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to select from among the low staining sensitizing dyes disclosed in U.S. Pat. Nos. 5,292,634; 5,316,904; 5,418,126 and 5,492,802. Use of low staining sensitizing dyes in a photographic element processed in a developer solution with little or no optical brightening agent (for instance, stilbene compounds such as Blankophor REU™) is specifically contemplated. Further, these low staining dyes can be used in combination with other dyes known to the art (Research Disclosure, September 1996, Item 38957, Section V).

Useful sensitizing dyes include, but are not limited to, the following.

BSD-1

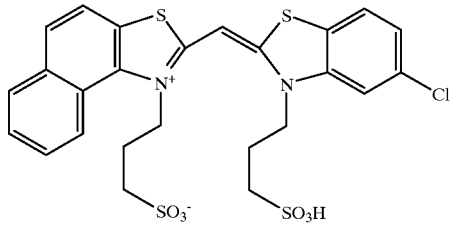

BSD-2

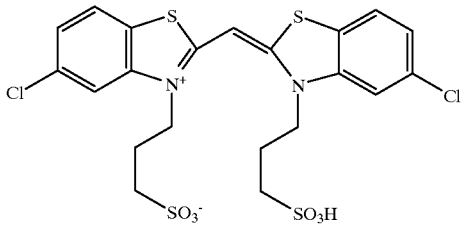

-continued
BSD-3
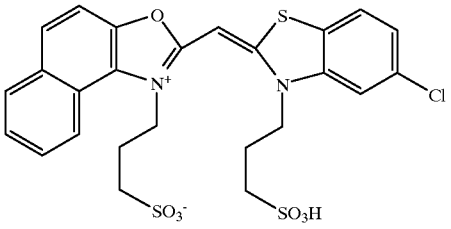
BSD-4
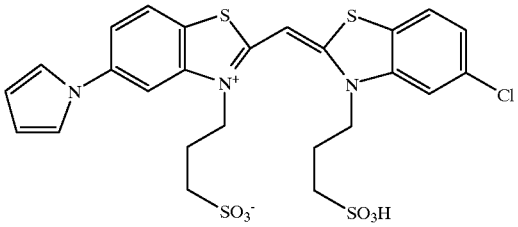
GSD-1
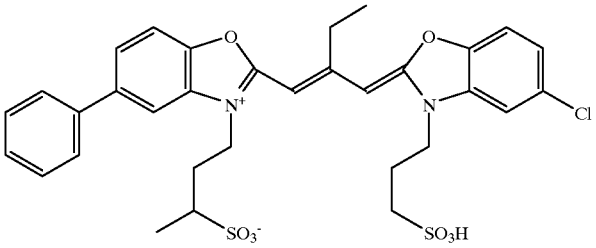
GSD-2
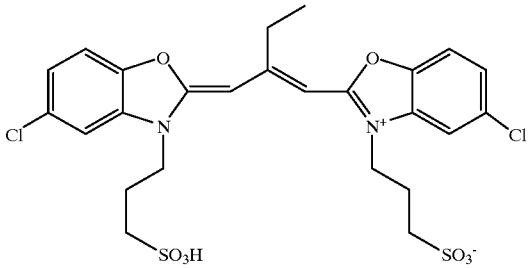
GSD-3
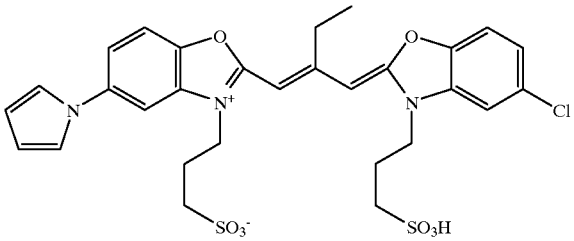

-continued

GSD-4

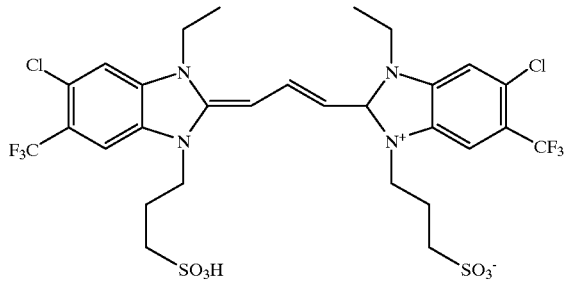

RSD-1

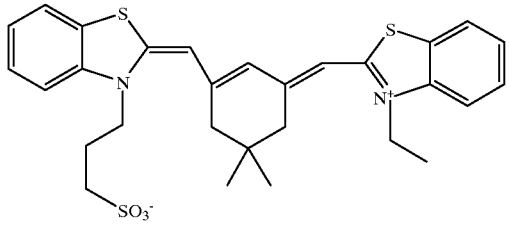

RSD-2

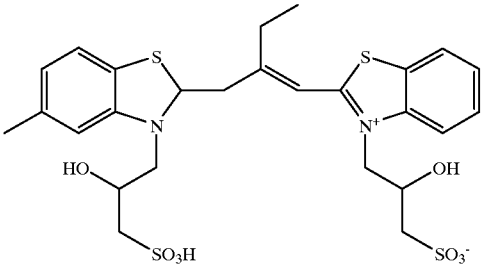

RSD-3

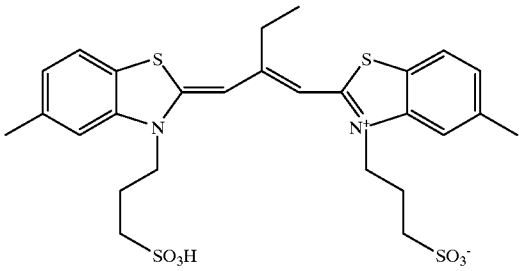

RSD-4

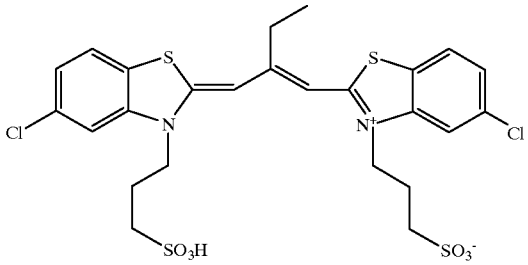

Emulsions can be spectrally sensitized with mixtures of two or more sensitizing dyes which form mixed dye aggregates on the surface of the emulsion grain. The use of mixed dye aggregates enables adjustment of the spectral sensitivity of the emulsion to any wavelength between the extremes of the wavelengths of peak sensitivities (λ-max) of the two or more dyes. This practice is especially valuable if the two or more sensitizing dyes absorb in similar portions of the spectrum (i.e., blue, or green or red and not green plus red or blue plus red or green plus blue). Since the function of the spectral sensitizing dye is to modulate the information recorded in the negative which is recorded as an image dye, positioning the peak spectral sensitivity at or near the λ-max of the image dye in the color negative produces the optimum preferred response. In addition, the combination of similarly spectrally sensitized emulsions can be in one or more layers.

An important quality characteristic of a reproductive film system is color reproduction, which represents how accurately the hues of the original scene are reproduced. Many current color papers use a blue sensitizing dye that gives a maximum sensitivity at about 480 nm. Use of a sensitizing dye that affords a sensitivity maximum that is closer to that of the yellow image dye in film, for instance with a sensitivity maximum of around 450–470 nm, can result in a color paper with improved color reproduction.

In the simplest contemplated form a recording element contemplated for use in the electronic printing method of one embodiment of the invention can consist of a single emulsion layer satisfying the emulsion description provided above coated on a conventional photographic support, such as those described in Research Disclosure, Item 38957, cited above, XVI. Supports. In one preferred form the support is a white reflective support, such as photographic paper support or a film support that contains or bears a coating of a reflective pigment. To permit a print image to be viewed using an illuminant placed behind the support, it is preferred to employ a white translucent support, such as a Duratrans™ or Duraclear™ support.

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 491,197; 544,322; 556,700; 556,777; 565,096; 570,006; and 574,948.

Typical cyan couplers are represented by the following formulas:

CYAN-1

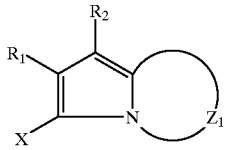

CYAN-2

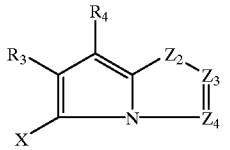

CYAN-3

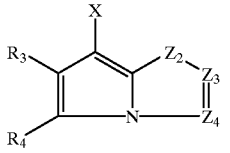

-continued

CYAN-4

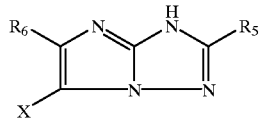

wherein $R_1$, $R_5$ and $R_8$ each represents a hydrogen or a substituent; $R_2$ represents a substituent; $R_3$, $R_4$ and $R_7$ each represents an electron attractive group having a Hammett's substituent constant of $\sigma_{para}$ of 0.2 or more and the sum of the $\sigma_{para}$ values of $R_3$ and $R_4$ is 0.65 or more; $R_6$ represents an electron attractive group having a Hammetts substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents —C($R_7$)═ and —N═; and $Z_3$ and $Z_4$ each represents —C($R_8$)═ and —N═.

For purposes of this invention, an "NB coupler" is a dye-forming coupler which is capable of coupling with the developer 4-amino-3-methyl-N-ethyl-N-(2-methanesulfonamidoethyl) aniline sesquisulfate hydrate to form a dye or which the left bandwidth (LBW) of its absorption spectra upon "spin coating" of a 3% w/v solution of the dye in di-n-butyl sebacate solvent is at least 5 nm. less than the LBW for a 3% w/v solution of the same dye in acetonitrile. The LBW of the spectral curve for a dye is the distance between the left side of the spectral curve and the wavelength of maximum absorption measured at a density of half the maximum.

The "spin coating" sample is prepared by first preparing a solution of the dye in di-n-butyl sebacate solvent (3% w/v). If the dye is insoluble, dissolution is achieved by the addition of some methylene chloride. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB couplers" form a dye which, in n-butyl sebacate, has a LBW of the absorption spectra upon "spin coating" which is at least 15 nm, preferably at least 25 nm, less than that of the same dye in a 3% solution (w/v) in acetonitrile.

In a preferred embodiment the cyan dye-forming "NB coupler" useful in the invention has the formula (IA)

(IA)

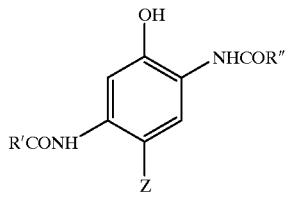

wherein

R' and R" are substituents selected such that the coupler is a "NB coupler", as herein defined; and Z is a hydrogen atom or a group which can be split off by the reaction of the coupler with an oxidized color developing agent.

The coupler of formula (IA) is a 2,5-diamido phenolic cyan coupler herein the substituents R' and R" are preferably independently selected from unsubstituted or substituted alky, aryl, amino, alkoxy and heterocyclyl groups.

In a further preferred embodiment, the "NB coupler" has the formula (I):

(I)

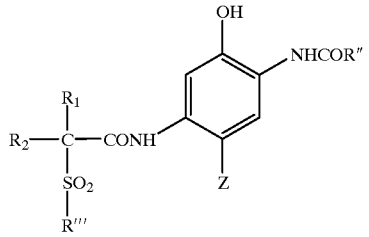

wherein

R" and R'" are independently selected from unsubstituted or substituted alkyl, aryl, amino, alkoxy, and heterocyclyl groups and Z is as hereinbefore defined;

$R_1$, and $R_2$ are independently hydrogen or an unsubstituted or substituted alkyl group; and Typically, R" is an alkyl, amino or aryl group, suitably a phenyl group. R'" is desirably an alkyl or aryl group or a 5- to 10-membered heterocyclic ring which contains one or more heteroatoms selected from nitrogen, oxygen and sulfur, which ring group is unsubstituted or substituted.

In the preferred embodiment the coupler of formula (I) is a 2,5-diamido phenol in which the 5-amido moiety is an amide of a carboxylic acid which is substituted in the alpha position by a particular sulfone ($—SO_2-$) group, such as, for example, described in U.S. Pat. No. 5,686,235. The sulfone moiety is an unsubstituted or substituted alkylsulfone or a heterocyclyl sulfone or it is an arylsulfone, which is preferably substituted, in particular in the meta and/or para position.

Couplers having these structures of formulae (I) or (IA) comprise cyan dye-forming "NB couplers" which form image dyes having very sharp-cutting dye hues on the short wavelength side of the absorption curves with absorption maxima ($\lambda_{max}$) which are shifted hypsochromically and are generally in the range of 620–645 nm, which is ideally suited for producing excellent color reproduction and high color saturation in color photographic papers.

Referring to formula (I), $R_1$ and $R_2$ are independently hydrogen or an unsubstituted or substituted alkyl group, preferably having from 1 to 24 carbon atoms and in particular 1 to 10 carbon atoms, suitably a methyl, ethyl, n-propyl, isopropyl, butyl or decyl group or an alkyl group substituted with one or more fluoro, chloro or bromo atoms, such as a trifluoromethyl group. Suitably, at least one of $R_1$ and $R_2$ is a hydrogen atom and if only one of $R_1$ and $R_2$ is a hydrogen atom then the other is preferably an alkyl group having 1 to 4 carbon atoms, more preferably one to three carbon atoms and desirably two carbon atoms.

As used herein and throughout the specification unless where specifically stated otherwise, the term "alkyl" refers to an unsaturated or saturated straight or branched chain alkyl group, including alkenyl, and includes aralkyl and cyclic alkyl groups, including cycloalkenyl, having 3–8 carbon atoms and the term 'aryl' includes specifically fused aryl.

In formula (I), R" is suitably an unsubstituted or substituted amino, alkyl or aryl group or a 5- to 10-membered heterocyclic ring which contains one or more heteroatoms selected from nitrogen, oxygen and sulfur, which ring is unsubstituted or substituted, but is more suitably an unsubstituted or substituted phenyl group.

Examples of suitable substituent groups for this aryl or heterocyclic ring include cyano, chloro, fluoro, bromo, iodo, alkyl- or aryl-carbonyl, alkyl- or aryl-oxycarbonyl, carbonamido, alkyl- or aryl-carbonamido, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfonamido, aryl, alkyl, alkoxy, aryloxy, nitro, alkyl- or aryl-ureido and alkyl- or aryl-carbamoyl groups, any of which may be further substituted. Preferred groups are halogen, cyano, alkoxycarbonyl, alkylsulfamoyl, alkyl-sulfonamido, alkylsulfonyl, carbamoyl, alkylcarbamoyl or alkylcarbonamido. Suitably, R" is a 4-chlorophenyl, 3,4-di-chlorophenyl, 3,4-difluorophenyl, 4-cyanophenyl, 3-chloro-4-cyanophenyl, pentafluorophenyl, or a 3- or 4-sulfonamidophenyl group.

In formula (I), when R'" is alkyl it may be unsubstituted or substituted with a substituent such as halogen or alkoxy. When R'" is aryl or a heterocycle, it may be substituted. Desirably it is not substituted in the position alpha to the sulfonyl group.

In formula (I), when R'" is a phenyl group, it may be substituted in the meta and/or para positions with one to three substituents independently selected from the group consisting of halogen, and unsubstituted or substituted alkyl, alkoxy, aryloxy, acyloxy, acylamino, alkyl- or aryl-sulfonyloxy, alkyl- or aryl-sulfamoyl, alkyl- or aryl-sulfamoylamino, alkyl- or aryl-sulfonamido, alkyl- or aryl-ureido, alkyl- or aryl-oxycarbonyl, alkyl- or aryl-oxy-carbonylamino and alkyl- or aryl-carbamoyl groups.

In particular each substituent may be an alkyl group such as methyl, t-butyl, heptyl, dodecyl, pentadecyl, octadecyl or 1,1,2,2-tetramethylpropyl; an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecyl-phenoxy; an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methyl-sulfonyloxy, dodecylsulfonyloxy or 4methylphenyl-sulfonyloxy; an alkyl- or aryl-sulfamoyl-group such as N-butylsulfamoyl or N-4-t-butylphenylsulfamoyl; an alkyl- or aryl-sulfamoylamino group such as N-butyl-sulfamoylamino or N-4-t-butylphenylsulfamoyl-amino; an alkyl- or aryl-sulfonamido group such as methane-sulfonamido, hexadecanesulfonamido or 4-chlorophenyl-sulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxy-carbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably the above substituent groups have 1 to 30 carbon atoms, more preferably 8 to 20 aliphatic carbon atoms. A desirable substituent is an alkyl group of 12 to 18 aliphatic carbon atoms such as dodecyl, pentadecyl or octadecyl or an alkoxy group with 8 to 18 aliphatic carbon atoms such as dodecyloxy and hexadecyloxy or a halogen such as a meta or para chloro group, carboxy or sulfonamnido. Any such groups may contain interrupting heteroatoms such as oxygen to form e.g. polyalkylene oxides.

In formula (I) or (IA) Z is a hydrogen atom or a group which can be split off by the reaction of the coupler with an oxidized color developing agent, known in the photographic art as a 'coupling-off group' and may preferably be hydrogen, chloro, fluoro, substituted aryloxy or mercaptotetrazole, more preferably hydrogen or chloro.

The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclylsulfonamido, heterocyclylthio, benzothiazolyl, phosophonyloxy, alkylthio, arylthio, and arylazo. These coupling-off groups are described in the art, for example, in U.S. Pat. Nos. 2,455,169; 3,227,551; 3,432,521; 3,467,563; 3,617,291; 3,880,661; 4,052,212; and 4,134,766; and in U.K. Patent Nos. and published applications 1,466,728; 1,531,927; 1,533,039; 2,066,755A; and 2,017,704A. Halogen, alkoxy and aryloxy groups are most suitable.

Examples of specific coupling-off groups are —Cl, —F, —Br, —SCN, —$OCH_3$, —$OC_6H_5$, —$OCH_2C(=O)NHCH_2CH_2OH$, —$OCH_2C(O)NHCH_2CH_2OCH_3$, —$OCH_2C(O)NHCH_2CH_2OC(=O)OCH_3$, —$P(=O)(OC_2H_5)_2$, —$SCH_2CH_2COOH$,

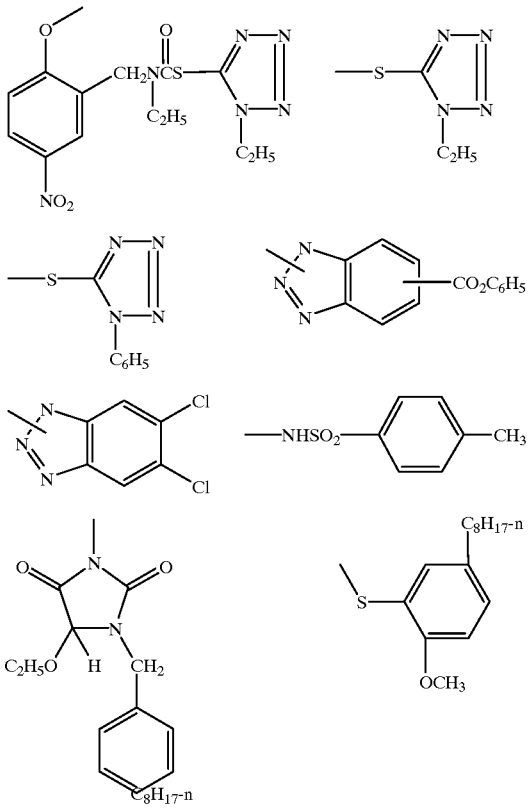

-continued

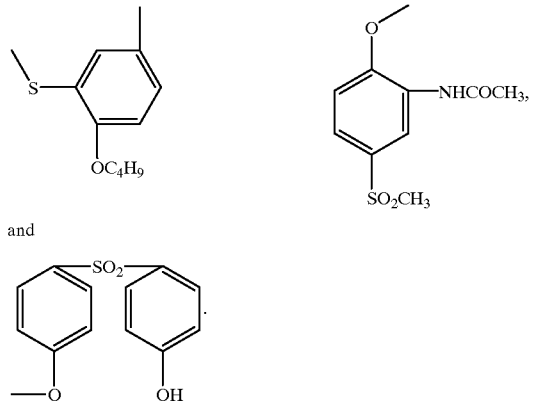

Typically, the coupling-off group is a chlorine atom, hydrogen atom or p-methoxyphenoxy group.

It is essential that the substituent groups be selected so as to adequately ballast the coupler and the resulting dye in the organic solvent in which the coupler is dispersed. The ballasting may be accomplished by providing hydrophobic substituent groups in one or more of the substituent groups.

Generally a ballast group is an organic radical of such size and configuration as to confer on the coupler molecule sufficient bulk and aqueous insolubility as to render the coupler substantially nondiffusible from the layer in which it is coated in a photographic element. Thus, the combination of substituent are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (I) is a small alkyl group or hydrogen. Therefore, in these embodiments the ballast would be primarily located as part of the other groups. Furthermore, even if the coupling-off group Z contains a ballast it is often necessary to ballast the other substituents as well, since Z is eliminated from the molecule upon coupling; thus, the ballast is most advantageously provided as part of groups other than Z.

The following examples further illustrate preferred coupler of the invention. It is not to be construed that the present invention is limited to these examples.

IC-1

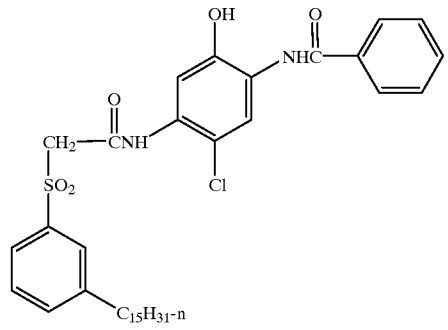

-continued
IC-2
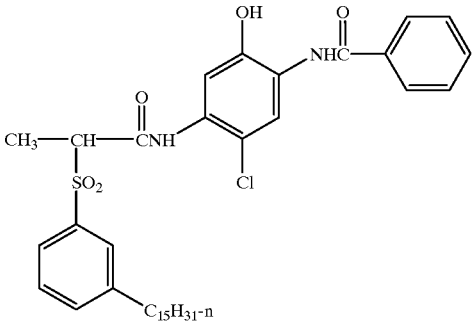
IC-3
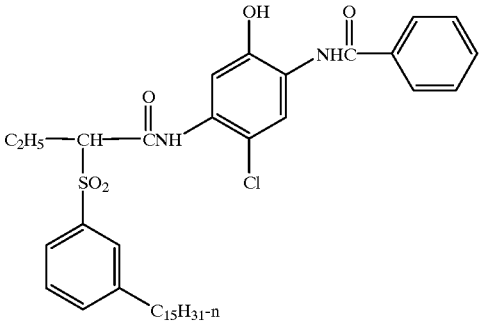
IC-4
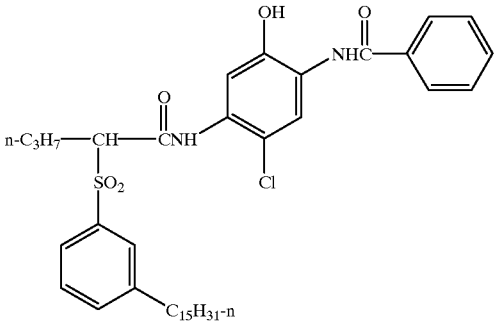
IC-5
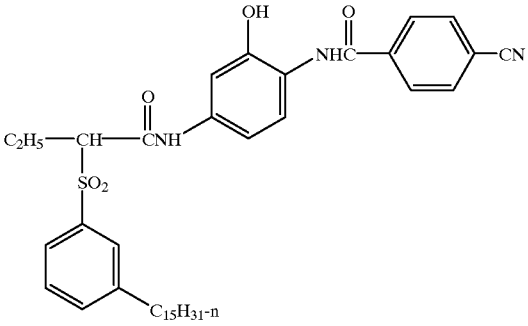
-continued
IC-6
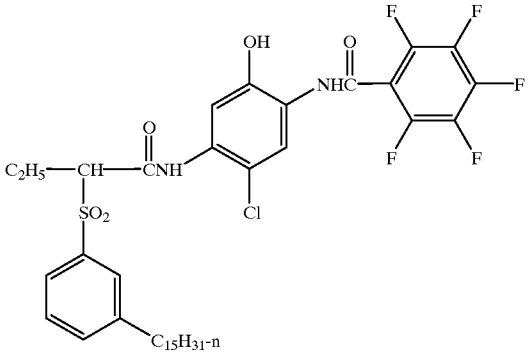
IC-7
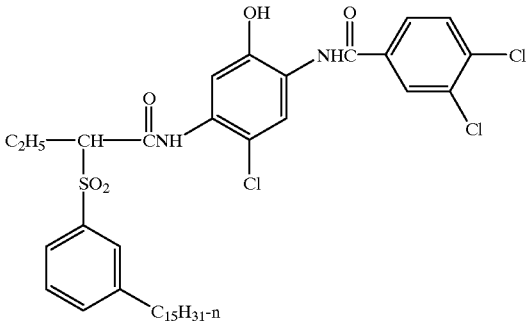
IC-8
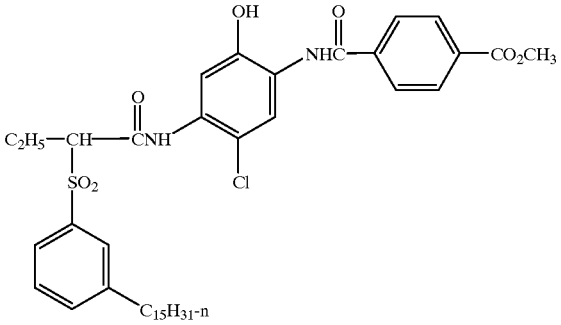
IC-9
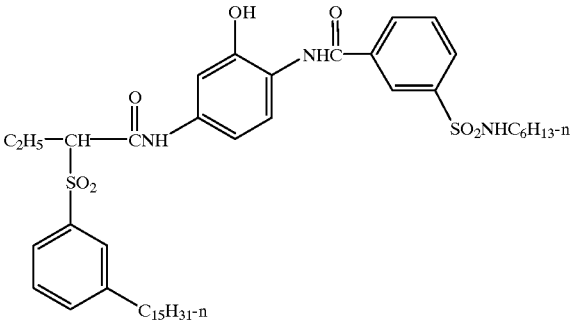

-continued
IC-10
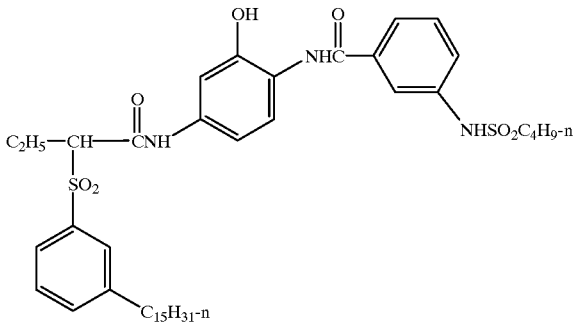
IC-11
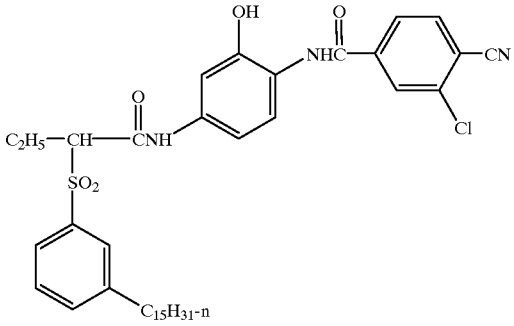
IC-12
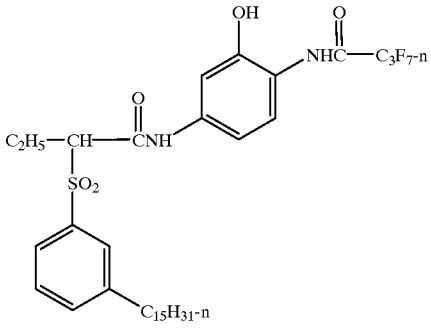
IC-13
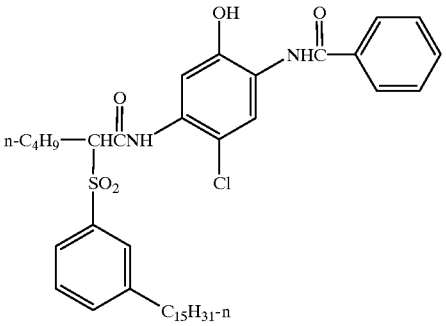
-continued
IC-14
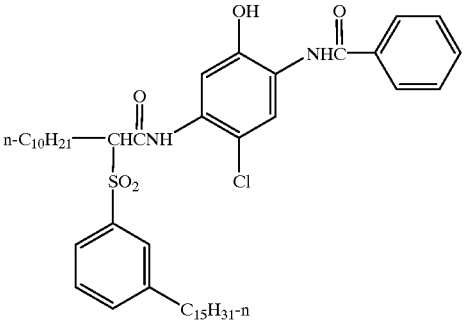
IC-15
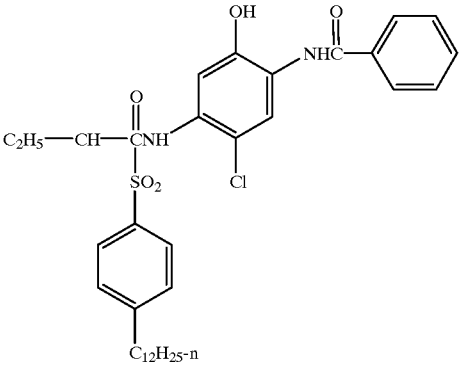
IC-16
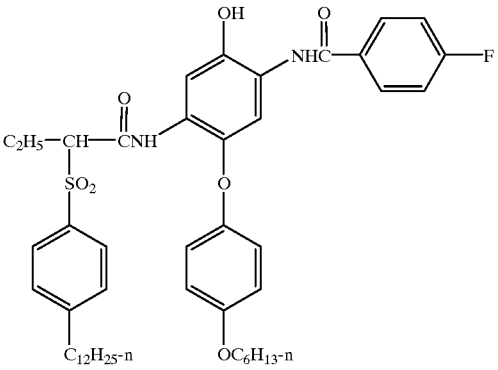
IC-17
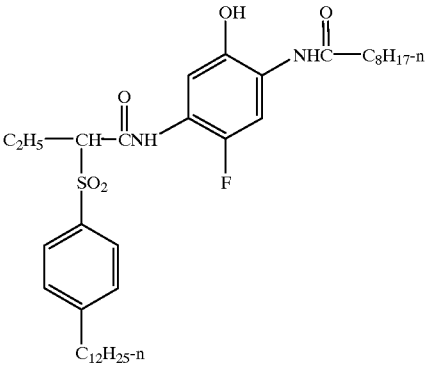

-continued
IC-18
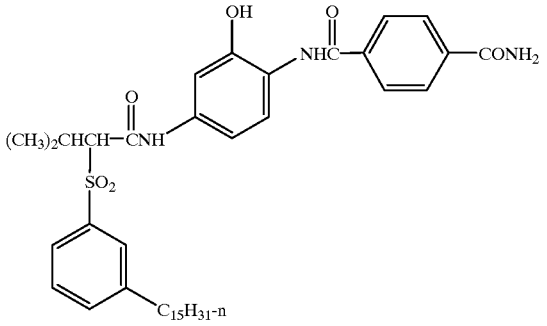
IC-19
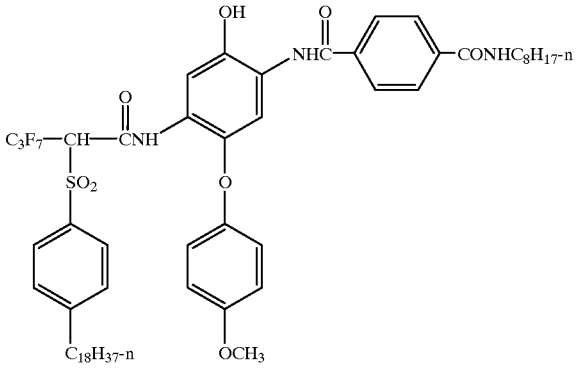
IC-20
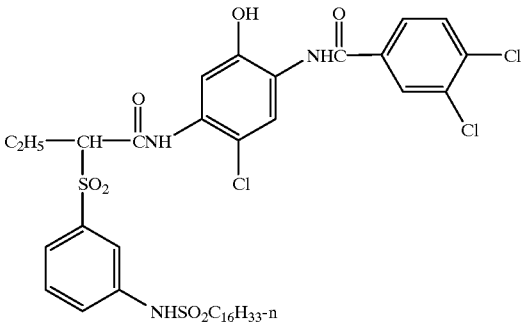
IC-21
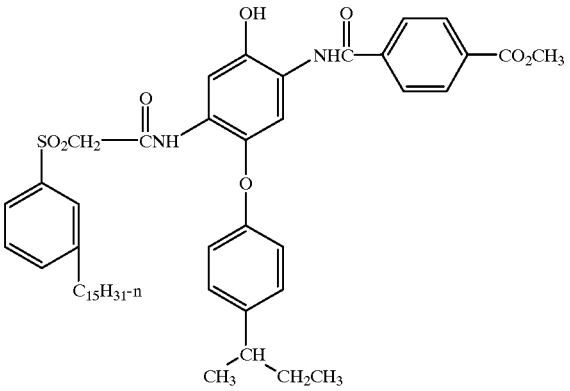
-continued
IC-22
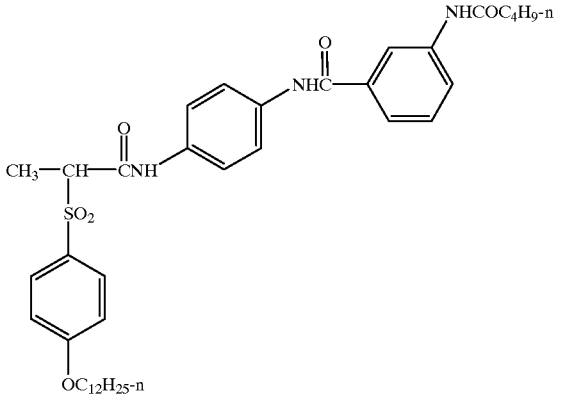
IC-23
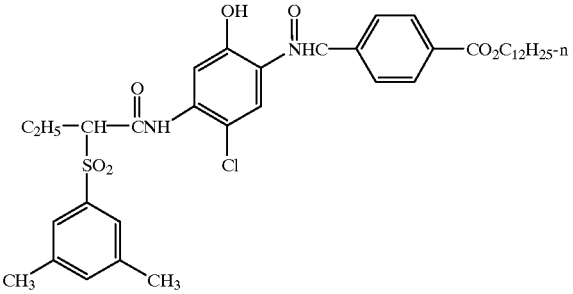
IC-24
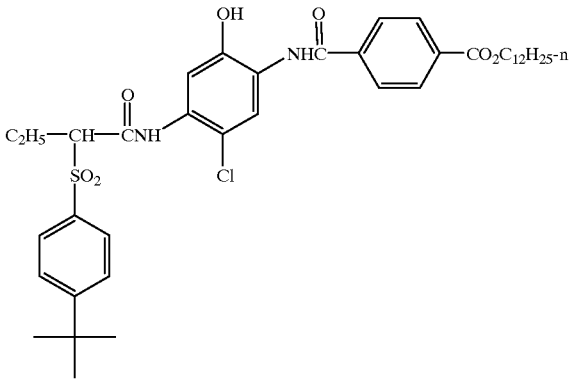
IC-25
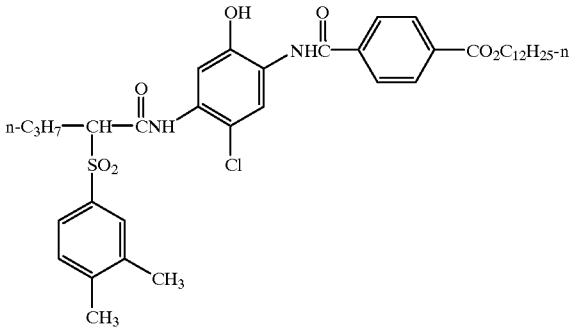

-continued
IC-26
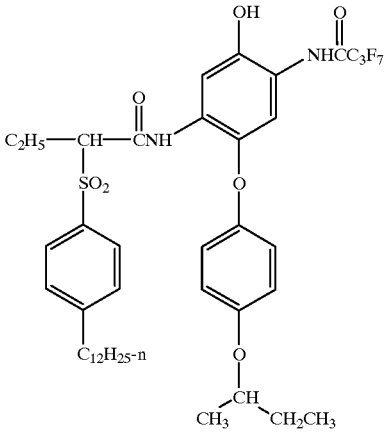
IC-27
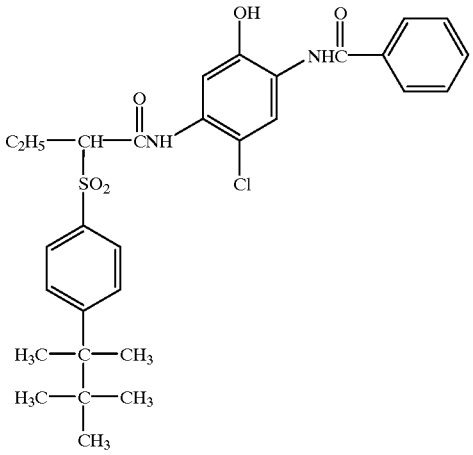
IC-28
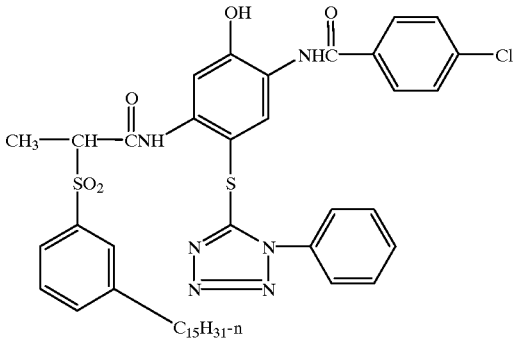
-continued
IC-29
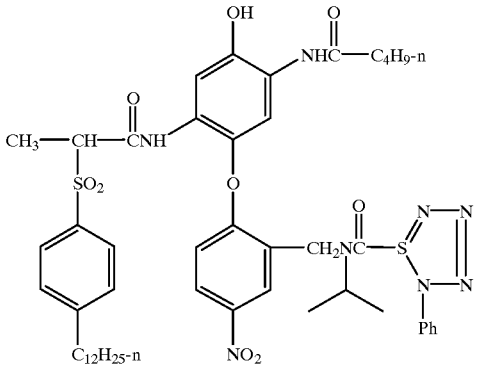
IC-30
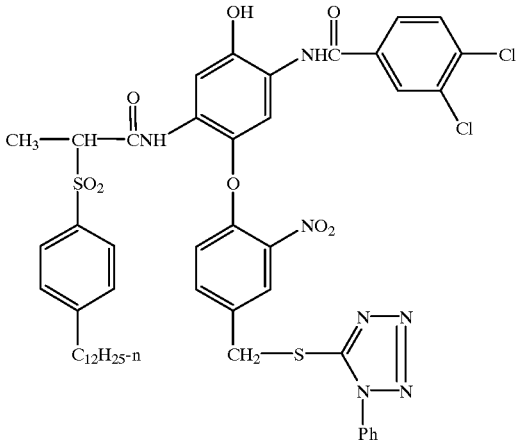
IC-31
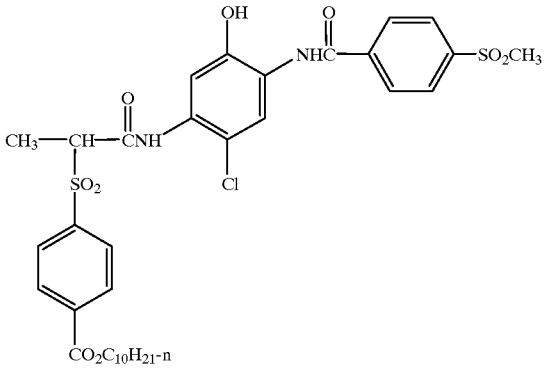
IC-32
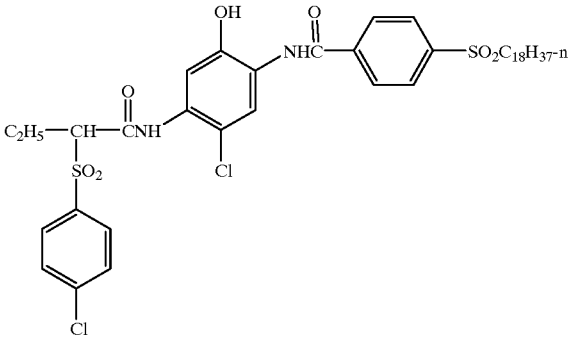

-continued
IC-33
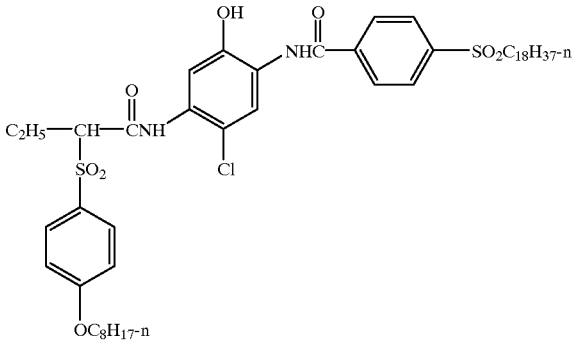
IC-34
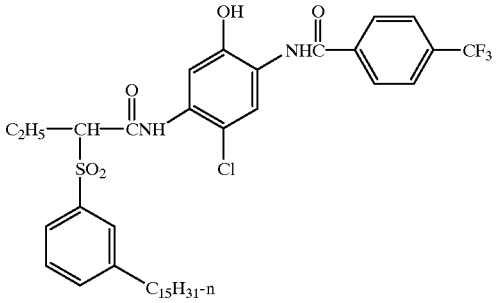
IC-35
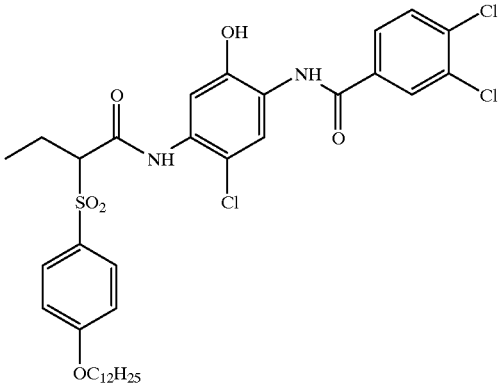
IC-36
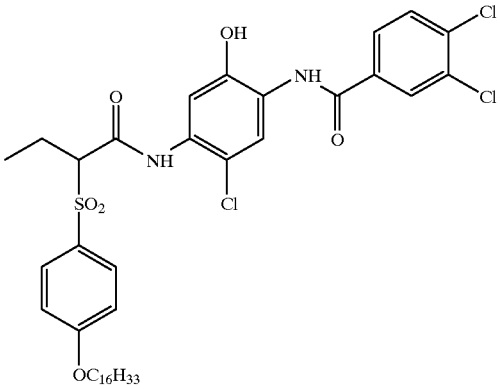
-continued
IC-37
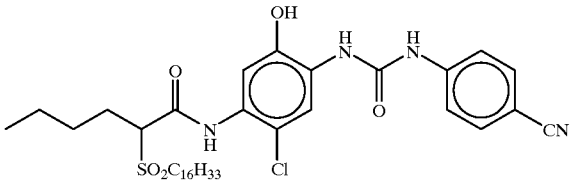
IC-38
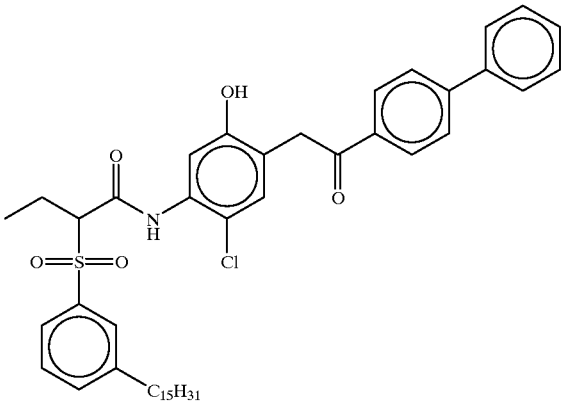
IC-39
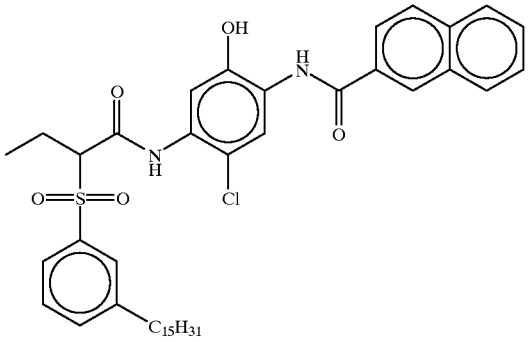
IC-40
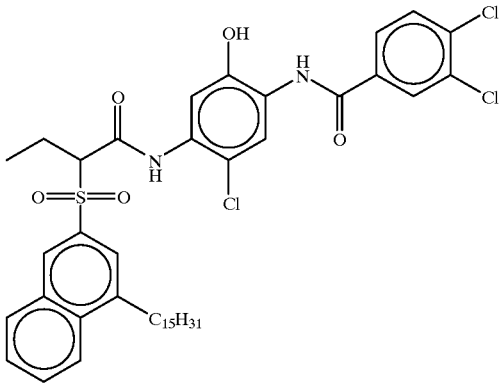
Preferred couplers are IC-3, IC-7, IC-35, and IC-36 because of their suitably narrow left bandwidths.
Couplers that form magenta dyes upon reaction with oxidized color developing agent are described in such representative patents and publications as: U.S. Pat. Nos. 2,311, 082; 2,343,703; 2,369,489; 2,600,788; 2,908,573; 3,062,653; 3,152,896; 3,519,429; 3,758,309; and "Farbkupplereine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1 -c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S. Patent Nos. 4,659,652; 5,066,575; and 5,250,400.

Typical pyrazoloazole and pyrazolone couplers are represented by the following formulas:

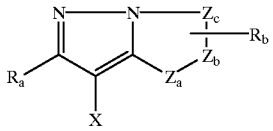

MAGENTA-1

-continued

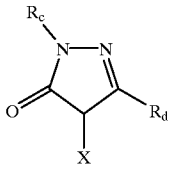

MAGENTA-2 wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Specific examples of such couplers are:

M-1

M-1

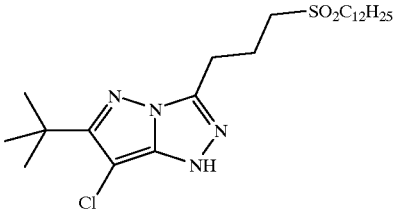

M-2

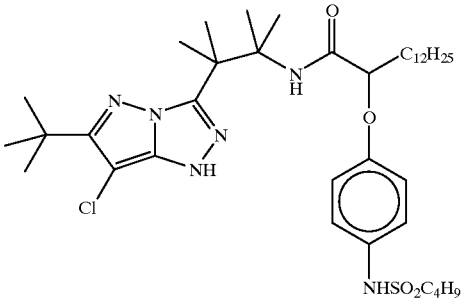

M-3

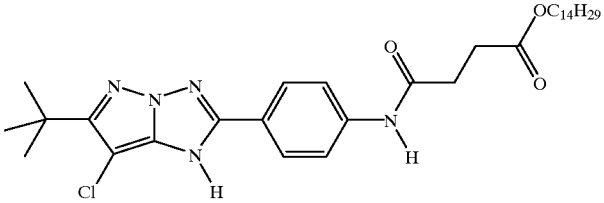

-continued

M-4

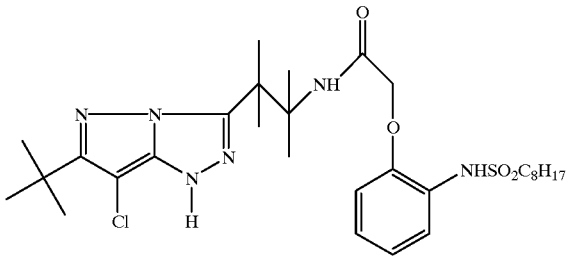

M-5

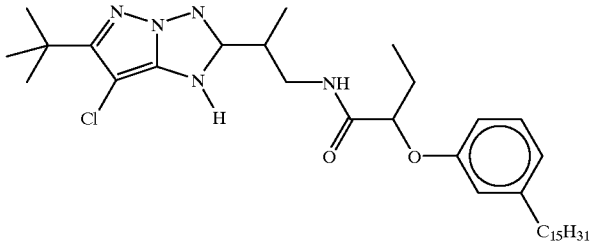

Couplers that form yellow dyes upon reaction with oxidized color developing agent are described in such representative patents and publications as: U.S. Pat. Nos. 2,298,443; 2,407,210; 2,875,057; 3,048,194; 3,265,506; 3,447,928; 3,960,570; 4,022,620; 4,443,536; 4,910,126; and 5,340,703 and "Farbkuppler-eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803. For improved color reproduction, couplers which give yellow dyes that cut off sharply on the long wavelength side are particularly preferred (for example, see U.S. Pat. No. 5,360,713).

Typical preferred yellow couplers are represented by the following formulas:

YELLOW-1

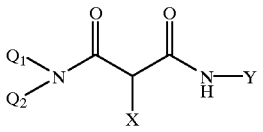

YELLOW-2

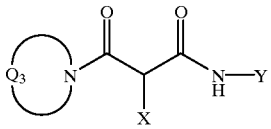

-continued

YELLOW-3

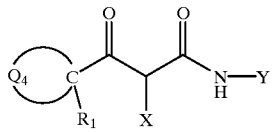

YELLOW-4

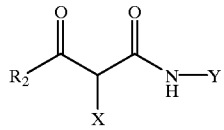

wherein $R_1$, $R_2$, $Q_1$ and $Q_2$ each represents a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represents an alkyl group, an aryl group, or a heterocyclic group, and $R_2$ represents an aryl or tertiary alkyl group.

Preferred yellow couplers can be of the following general structures

Y-1
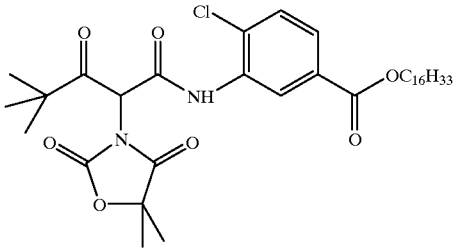
Y-2
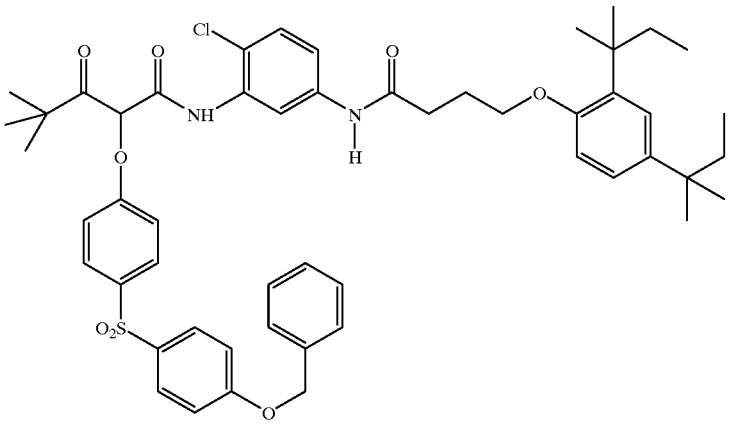
Y-3
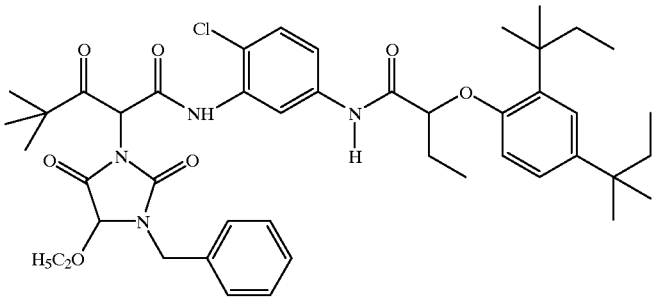
Y-4
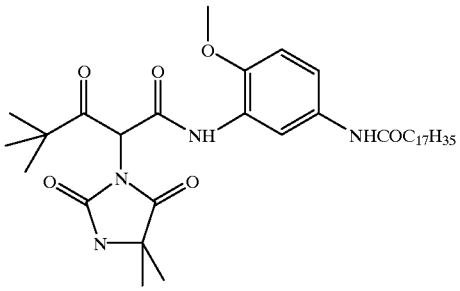
Y-5
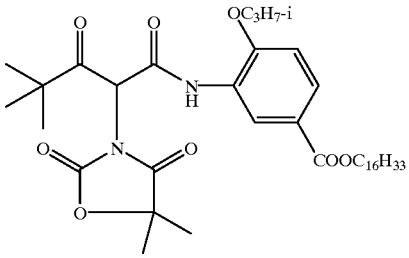

-continued

Y-6

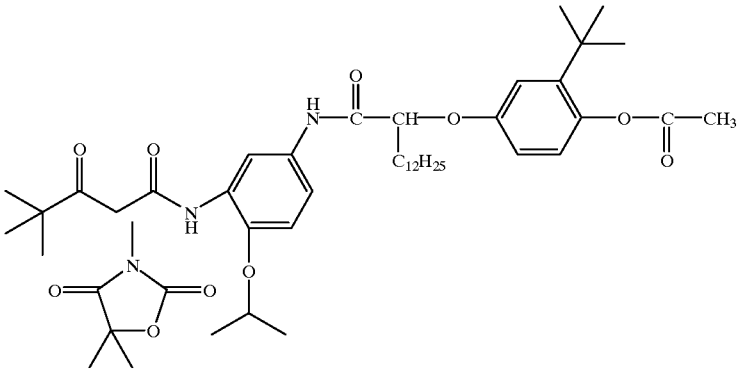

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-1-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxymarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amino, such as phenylanilino, 2-chloroanilino, diethylamino, dodecylamino; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

Stabilizers and scavengers that can be used in these photographic elements, but are not limited to, the following.

ST-1

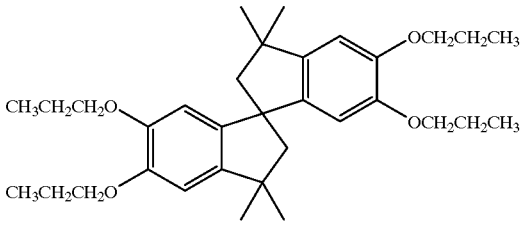

ST-2

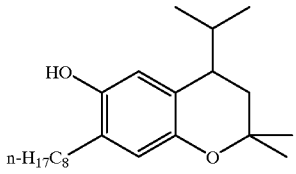

ST-3

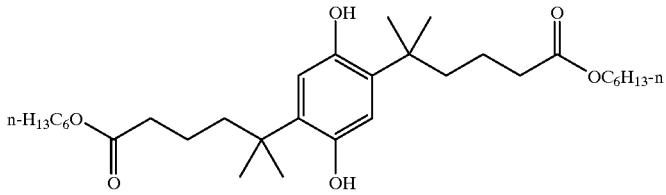

ST-4

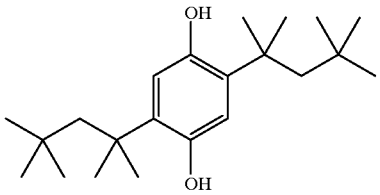

ST-5

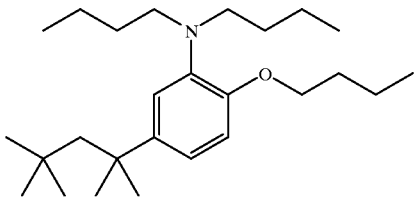

ST-6

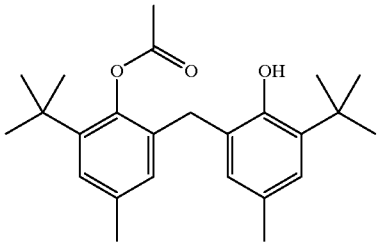

ST-7

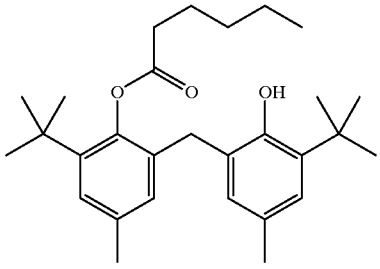

ST-8

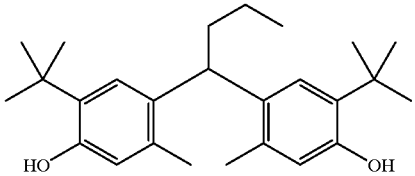

ST-9

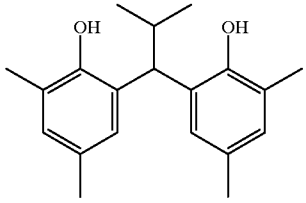

-continued
ST-10
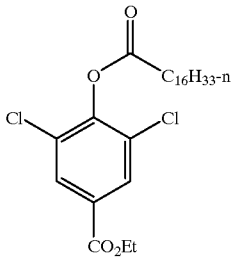
ST-11
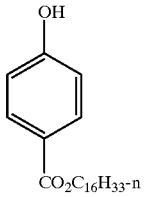
ST-12
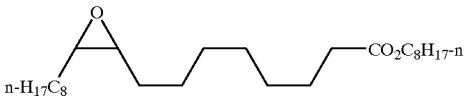
ST-13
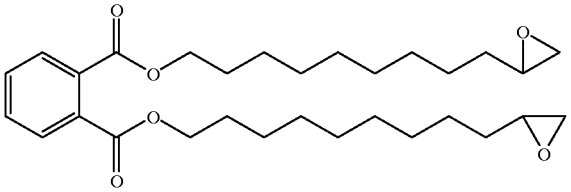
ST-14
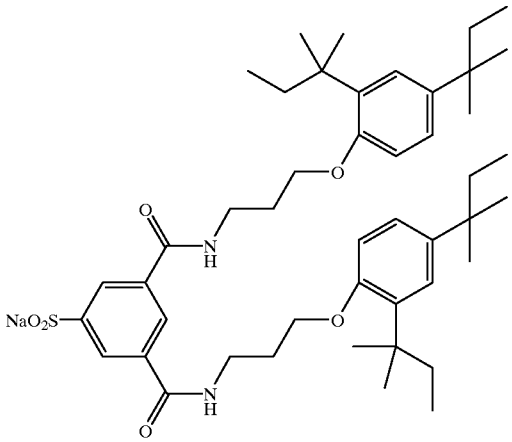
ST-15
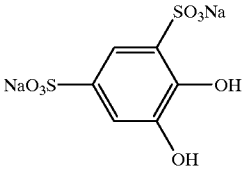
ST-16
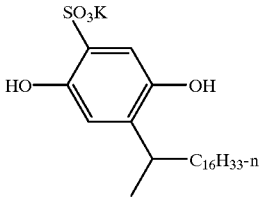
ST-17
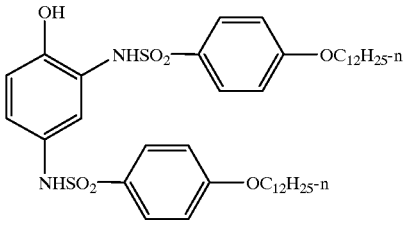
ST-18
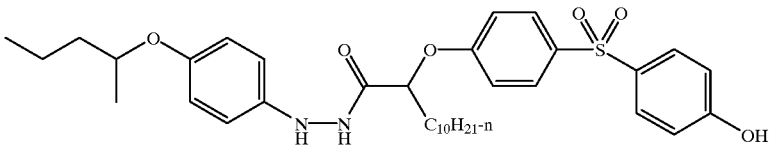

-continued

ST-19

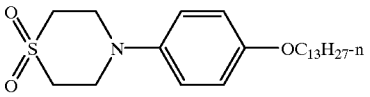

ST-20

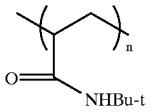

n = 75–8,000

ST-21

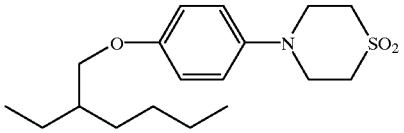

ST-22

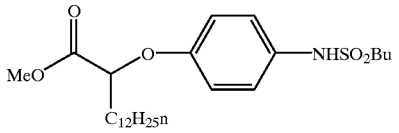

ST-23

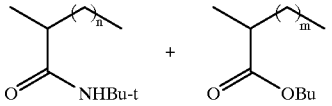

n:m 1:1 mw = 75–100,000

ST-24

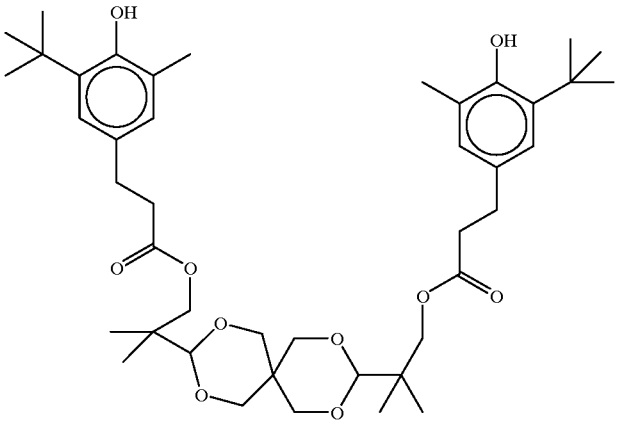

Examples of solvents which may be used in the invention include the following:

| | |
|---|---|
| Tritolyl phosphate | S-1 |
| Dibutyl phthalate | S-2 |
| Diundecyl phthalate | S-3 |
| N,N-Diethyldodecanamide | S-4 |
| N,N-Dibutyldodecanamide | S-5 |
| Tris(2-ethylhexyl)phosphate | S-6 |
| Acetyl tributyl citrate | S-7 |
| 2,4-Di-tert-pentylphenol | S-8 |
| 2-(2-Butoxyethoxy)ethyl acetate | S-9 |
| 1,4-Cyclohexyldimethylene bis(2-ethylhexanoate) | S-10 |

The dispersions used in photographic elements may also include ultraviolet (UV) stabilizers and so-called liquid UV stabilizers such as described in U.S. Pat. Nos. 4,992,358; 4,975,360; and 4,587,346. Examples of UV stabilizers are shown below.

UV-1

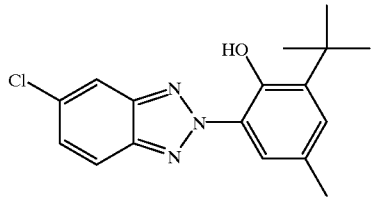

-continued
UV-2
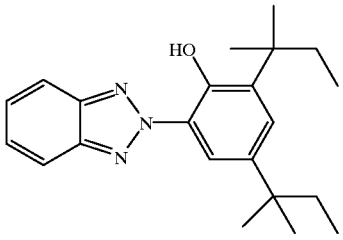
UV-3
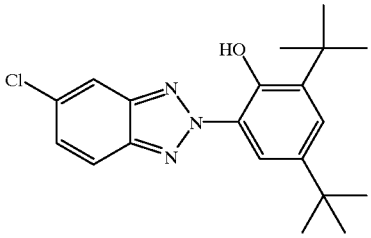
UV-4
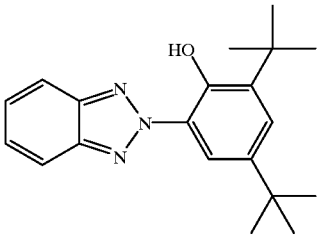
UV-5
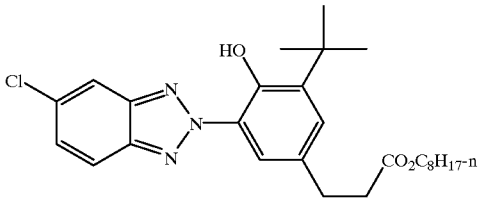
UV-6
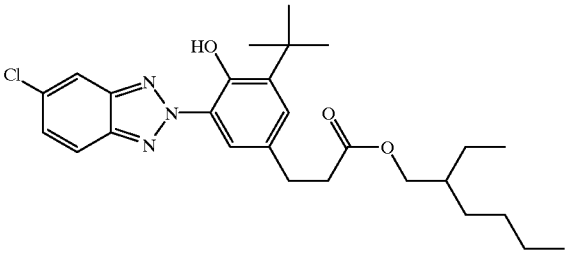
UV-7
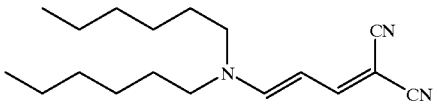
UV-8
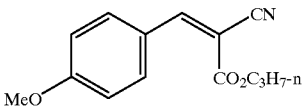
The aqueous phase may include surfactants. Surfactant may be cationic, anionic, zwitterionic, or non-ionic. Useful surfactants include, but are not limited to, the following:
SF-1
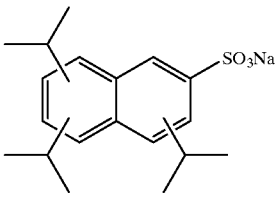
SF-2
$CF_3 \cdot (CF_2)_7 \cdot SO_3Na$
SF-3
$CH_3 \cdot (CH_2)_n \cdot SO_3Na$,
n = 12–14
SF-4
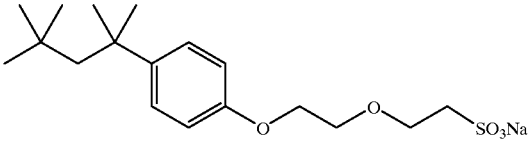
SF-5
$CH_3 \cdot (CH_2)_{11} \cdot OSO_3Na$
SF-6
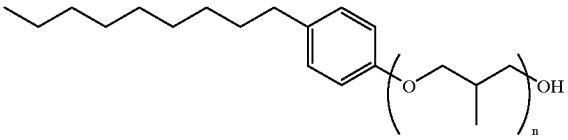
n = ca. 10
SF-7
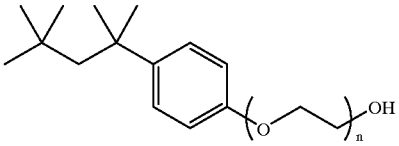
n = ca. 40
SF-8
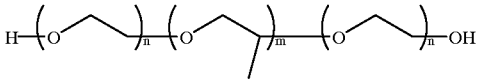
n = ca. 6, m = ca. 2
SF-9
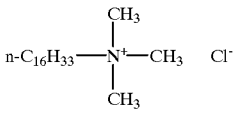
SF-10
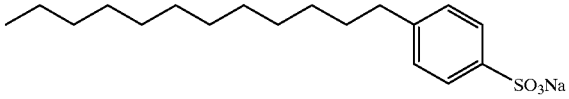
SF-11
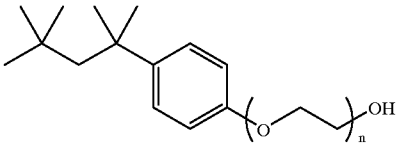

-continued n = ca. 10

SF-12

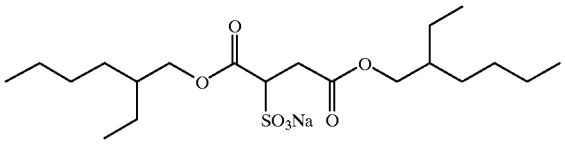

Further, it is contemplated to stabilize photographic dispersions prone to particle growth through the use of hydrophobic, photographically inert compounds such as disclosed by Zengerle et al U.S. Pat. No. 5,468,604.

The photographic elements may also contain filter dye layers comprising colloidal silver sol or yellow, cyan, and/or magenta filter dyes, either as oil-in-water dispersions, latex dispersions or as solid particle dispersions. Useful examples of absorbing materials are discussed in Research Disclosure, September 1996, Item 38957, Section VIII.

The photographic elements may also contain light absorbing materials that can increase sharpness and be used to control speed and minimum density. Examples of useful absorber dyes are described in U.S. Pat. Nos. 4,877,721; 5,001,043; 5,153,108; and 5,035,985. Solid particle dispersion dyes are described in U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179; and 5,266,454. Useful dyes include, but are not limited to, the following.

DYE-1

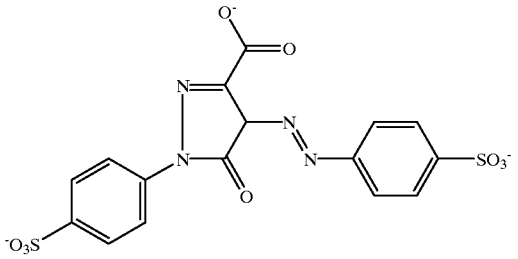

DYE-2

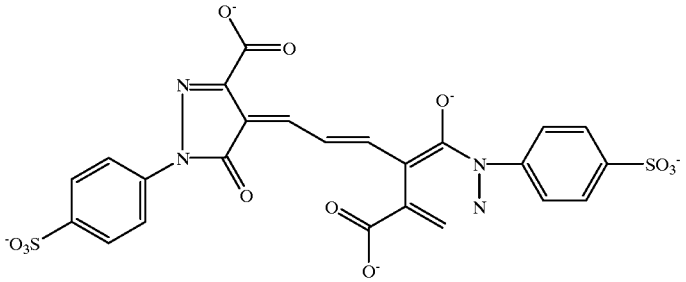

DYE-3

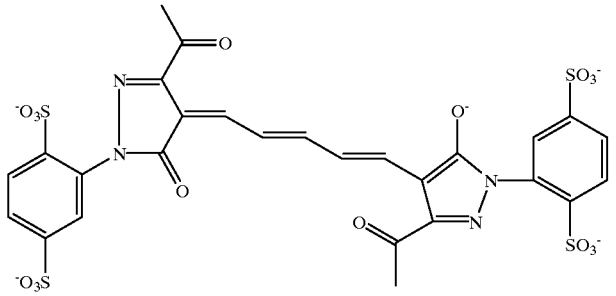

DYE-4

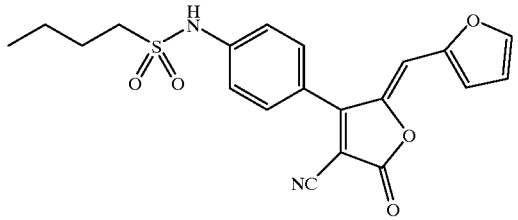

-continued
DYE-5
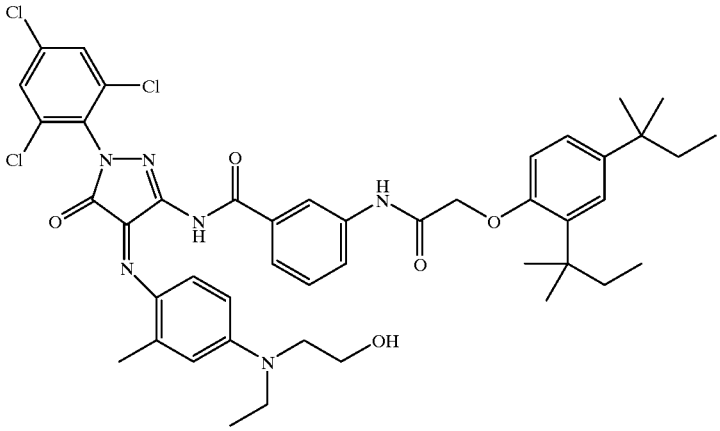
DYE-6
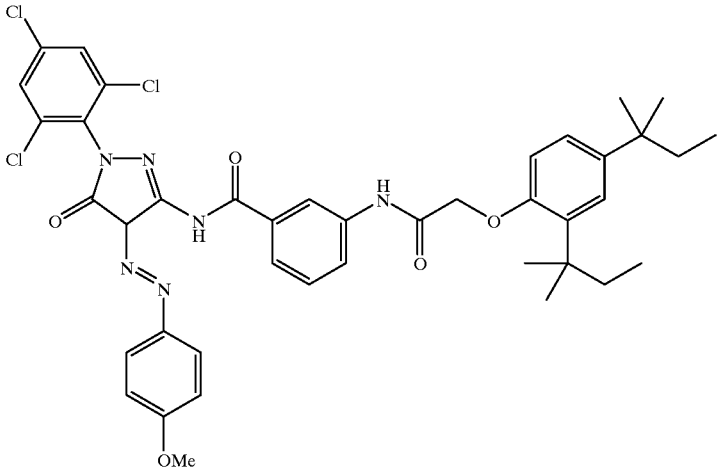
DYE-7
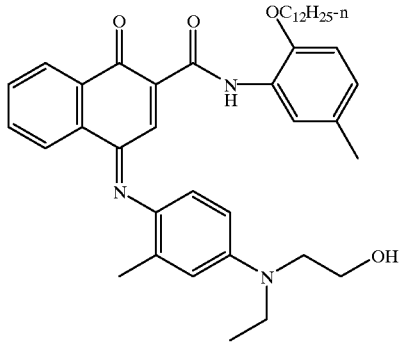

-continued

DYE-8

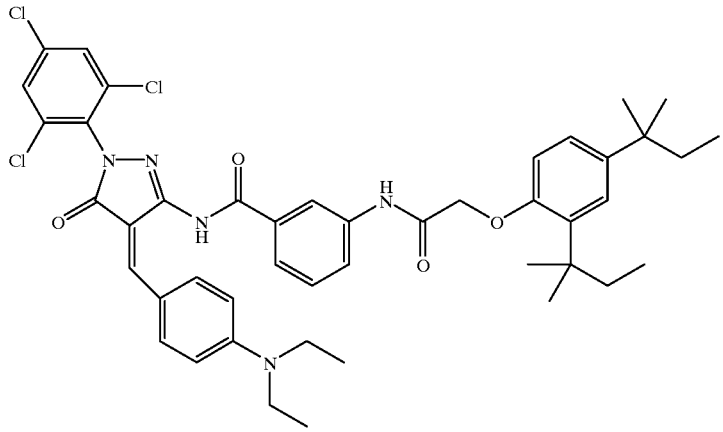

DYE-9

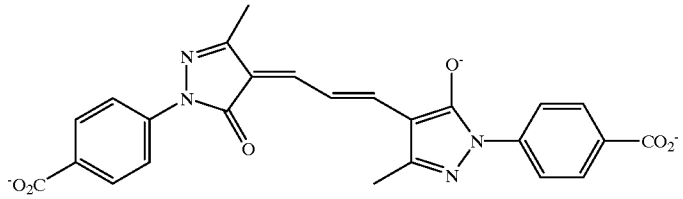

In a preferred embodiment the invention employs recording elements which are constructed to contain at least three silver halide emulsion layer units. A suitable full color, multilayer format for a recording element used in the invention is represented by Structure I.

| STRUCTURE I |
|---|
| Red-sensitized<br>cyan dye image-forming silver halide emulsion unit |
| Interlayer |
| Green-sensitized<br>magenta dye image-forming silver halide emulsion unit |
| Interlayer |
| Blue-sensitized<br>yellow dye image-forming silver halide emulsion unit |
| ///// Support ///// |

wherein the red-sensitized, cyan dye image-forming silver halide emulsion unit is situated nearest the support; next in order is the green-sensitized, magenta dye image-forming unit, followed by the uppermost blue-sensitized, yellow dye image-forming unit. The image-forming units are separated from each other by hydrophilic colloid interlayers containing an oxidized developing agent scavenger to prevent color contamination. Silver halide emulsions satisfying the grain and gelatino-peptizer requirements described above can be present in any one or combination of the emulsion layer units. Additional useful multicolor, multilayer formats for an element of the invention include structures as described in U.S. Pat. No. 5,783,373. Each of such structures in accordance with the invention preferably would contain at least three silver halide emulsions comprised of high chloride grains having at least 50 percent of their surface area bounded by {100} crystal faces and containing dopants from classes (i) and (ii), as described above. Preferably each of the emulsion layer units contains emulsion satisfying these criteria.

In a more preferred embodiment, the invention employs recording elements which are constructed as described in U.S. Ser. No. 08/792,486. In this embodiment, the invention employs recording elements which are constructed to contain at least three silver halide emulsion layer units and an interlayer adjacent to the blue sensitive emulsion layer Conventional features that can be incorporated into multilayer (and particularly multicolor) recording elements contemplated for use in the method of the invention are illustrated by Research Disclosure, Item 38957, cited above:

XI. Layers and layer arrangements

XII. Features applicable only to color negative

XIII. Features applicable only to color positive

B. Color reversal

C. Color positives derived from color negatives

XIV. Scan facilitating features.

The recording elements comprising the radiation sensitive high chloride emulsion layers according to this invention can be conventionally optically printed, or in accordance with a particular embodiment of the invention can be image-wise exposed in a pixel-by-pixel mode using suitable high energy radiation sources typically employed in electronic printing methods. Suitable actinic forms of energy encompass the ultraviolet, visible and infrared regions of the electromagnetic spectrum as well as electron-beam radiation and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892. Suitable exposures include those up to 2000 nm, preferably up to 1500 nm. Suitable light emitting diodes and commercially available laser sources are known and commercially available. Imagewise exposures at ambient, elevated or reduced temperatures and/or pressures can be employed within the useful response range of the recording element determined by conventional sensitometric techniques, as illustrated by T. H. James, *The Theory of the Photographic Process,* 4th Ed., Macmillan, 1977, Chapters 4, 6, 17, 18 and 23.

It has been observed that anionic $[MX_xY_yL_z]$ hexacoordination complexes, where M is a group 8 or 9 metal (preferably iron, ruthenium or iridium), X is halide or pseudohalide (preferably Cl, Br or CN) x is 3 to 5, Y is $H_2O$, y is 0 or 1, L is a C—C, H—C or C—N—H organic ligand, and Z is 1 or 2, are surprisingly effective in reducing high intensity reciprocity failure (HIRF), low intensity reciprocity failure (LIRF) and thermal sensitivity variance and in in improving latent image keeping (LIK). As herein employed HIRF is a measure of the variance of photographic properties for equal exposures, but with exposure times ranging from $10^{-1}$ to $10^{-6}$ second. LIRF is a measure of the varinance of photographic properties for equal exposures, but with exposure times ranging from $10^{-1}$ to 100 seconds. Although these advantages can be generally compatible with face centered cubic lattice grain structures, the most striking improvements have been observed in high (>50 mole %, preferably >90 mole %) chloride emulsions. Preferred C—C, H—C or C—N—H organic ligands are aromatic heterocycles of the type described in U.S. Pat. No. 5,462,849. The most effective C—C, H—C or C—N—H organic ligands are azoles and azines, either unsustituted or containing alkyl, alkoxy or halide substituents, where the alkyl moieties contain from 1 to 8 carbon atoms. Particularly preferred azoles and azines include thiazoles, thiazolines and pyrazines.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$ and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100 $\mu$ seconds, often up to 10 $\mu$ seconds, and frequently up to only 0.5 $\mu$ seconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer,* Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Pat. No. 5,126,235 and European Patent Applications 479 167 A1 and 502 508 A1.

Once imagewise exposed, the recording elements can be processed in any convenient conventional manner to obtain a viewable image. Such processing is illustrated by *Research Disclosure,* Item 38957, cited above:

XVIII. Chemical development systems

XIX. Development

XX. Desilvering, washing, rinsing and stabilizing

In addition, a useful developer for the inventive material is a homogeneous, single part developing agent. The homogeneous, single-part color developing concentrate is prepared using a critical sequence of steps:

In the first step, an aqueous solution of a suitable color developing agent is prepared. This color developing agent is generally in the form of a sulfate salt. Other components of the solution can include an antioxidant for the color developing agent, a suitable number of alkali metal ions (in an at least stoichiometric proportion to the sulfate ions) provided by an alkali metal base, and a photographically inactive water-miscible or water-soluble hydroxy-containing organic solvent. This solvent is present in the final concentrate at a concentration such that the weight ratio of water to the organic solvent is from about 15:85 to about 50:50.

In this environment, especially at high alkalinity, alkali metal ions and sulfate ions form a sulfate salt that is precipitated in the presence of the hydroxy-containing organic solvent. The precipitated sulfate salt can then be readily removed using any suitable liquid/solid phase separation technique (including filtration, centrifugation or decantation). If the antioxidant is a liquid organic compound, two phases may be formed and the precipitate may be removed by discarding the aqueous phase.

The color developing concentrates of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure,* publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect the color developing agents from oxidation, one or more antioxidants are generally included in the color developing compositions. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones. Mixtures of compounds from the same or different classes of antioxidants can also be used if desired.

Especially useful antioxidants are hydroxylamine derivatives as described for example, in U.S. Pat. Nos. 4,892,804; 4,876,174; 5,354,646; and 5,660,974, all noted above, and U.S. Pat. No. 5,646,327 (Bums et al). Many of these antioxidants are mono- and dialkylhydroxylamines having one or more substituents on one or both alkyl groups. Particularly useful alkyl substituents include sulfo, carboxy, amino, sulfonamido, carbonamido, hydroxy, and other solubilizing substituents.

More preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al) as having the structure I:

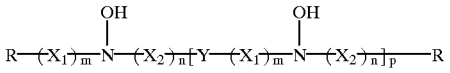

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is —$CR_2(OH)CHR_1$— and $X_2$ is —$CHR_1CR_2(OH)$— wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure I, m, n, and p are independently 0 or 1. Preferably, each of m and n is 1, and p is 0.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

The following examples illustrate the practice of this invention. They are not intended to be exhaustive of all possible variations of the invention. Parts and percentages are by weight unless otherwise indicated.

EXAMPLES

Example 1

In this example the color silver halide emulsion of the invention was coated on two imaging support materials. The first support material of the invention was constructed by laminating biaxially oriented sheets to cellulose photographic grade paper. The second support material, which is the control material, was constructed by melt extrusion coating with low density polyethylene cellulose photographic grade paper. The control material is typical of prior art photographic support materials. This example will show the improvement the invention has made compared to the control for digital printing performance. Further, this example will also show demonstrate the image sharpness, whiteness and durability improvement over prior art photographic base materials.

The support material utilized in the control consisted of melt extruded low density polyethylene applied to a photographic grade cellulose paper base. The low density polyethylene on the topside of the control support contains blue tint, anatase $TiO_2$ and optical brightener. The control support structure is typical of prior art color photographic base materials.

The following is a description of the invention and was prepared by extrusion laminating the following top and bottom biaxially oriented polymer sheets to the photographic grade cellulose paper described below:

Top Sheet (Emulsion Side)

A composite sheet consisting of 5 layers identified as L1, L2, L3, L4, and L5. L1 is the thin colored layer on the outside of the package to which the photosensitive silver halide layer was attached. L2 is the layer to which optical brightener and $TiO_2$ was added. The optical brightener used was Hostalux KS manufactured by Ciba-Geigy. A coated extrusion grade anatase $TiO_2$ was added to both L2 and L4. Table 1 below lists the characteristics of the layers of the top biaxially oriented sheet used in this example.

TABLE 1

| Layer | Material | Thickness, μm |
|---|---|---|
| L1 | LD Polyethylene + color concentrate | 0.75 |
| L2 | Polypropylene + 24% $TiO_2$ + OB | 6.65 |
| L3 | Voided Polypropylene | 21 |
| L4 | Polypropylene + 18% $TiO_2$ | 6.85 |
| L5 | Polypropylene | 0.76 |

Photographic Grade Cellulose Paper Base Used in the Invention

Paper base was produced for the invention using a standard fourdrinier paper machine and a blend of mostly bleached hardwood Kraft fibers. The fiber ratio consisted primarily of bleached poplar (38%) and maple/beech (37%) with lesser amounts of birch (18%) and softwood (7%). Fiber length was reduced from 0.73 mm length weighted average as measured by a Kajaani FS-200 to 0.55 mm length using high levels of conical refining and low levels of disc refining. Fiber lengths from the slurry were measured using a FS-200 Fiber Length Analyzer (Kajaani Automation Inc. ). Energy applied to the fibers as indicated by the total Specific Net Refining Power (SNRP) was 127 KW hr/metric ton. Two conical refiners were used in series to provide the total conical refiners SNRP value. This value was obtained by adding the SNRPs of each conical refiner. Two disc refiners were similarly used in series to provide a total Disk SNRP. Neutral sizing chemical addenda, utilized on a dry weight basis, included alkyl ketone dimmer at 0.20% addition, cationic starch (1.0%), polyaminoamide epichlorohydrin (0.50%), polyacrylamide resin (0.18%), diaminostilbene optical brightener (0.20 %), and sodium bicarbonate. Surface sizing using hydroxyethylated starch and sodium chloride was also employed but is not critical to the invention. In the 3rd Dryer section, ratio drying was utilized to provide a moisture bias from the face side to the wire side of the sheet. The face side (emulsion side) of the sheet was then remoisturized with conditioned steam immediately prior calendering. Sheet temperatures were raised to between 76° C. and 93° C. just prior to and during calendering. The paper was then calendered to an apparent density of 1.17. Moisture levels after the calender were 7.0% to 9.0% by weight. Paper base B was produced at a basis weight of 178 g/mm$^2$ and thickness of 0.1524 mm.

The bottom biaxially oriented sheet laminated to the backside of invention base was a one-side matte finish, one-side treated biaxially oriented polypropylene sheet (25.6 μm thick) (d=0.90 g/cc) consisting of a solid oriented polypropylene layer and a skin layer of a mixture of polyethylenes and a terpolymer comprising ethylene, propylene, and butylene. The skin layer was on the bottom and the polyproylene layer and laminated to the paper.

Bottom Sheet (Backside)

The top sheet used in this example was coextruded and biaxially oriented. The top sheet was melt extrusion laminated to the above cellulose paper base using a metallocene catalyzed ethylene plastomer (SLP 9088) manufactured by Exxon Chemical Corp. The metallocene catalyzed ethylene plastomer had a density of 0.900 g/cc and a melt index of 14.0.

A coating was then applied to the laminated bottom biaxially oriented sheet on invention using a gravure coater to add the high frequency roughness to the backside. The coating consisted of an aqueous solution containing a sodium salt of styrene sulfonic acid. The coverage used was 25 mg per square meter and then dried to achieve a final web temperature between 55° C., the resultant coalesced latex material produced the desired high frequency roughness pattern. In addition to the sodium salt of styrene sulfonic acid, aluminum modified colloidal silicon dioxide particles were added to the aqueous latex material at a concentration of 50 milligrams per square meter. This further enhanced the high frequency roughness.

The L3 layer for the biaxially oriented sheet is microvoided and further described in Table 2 where the refractive index and geometrical thickness is shown for measurements made along a single slice through the L3 layer; they do not imply continuous layers; a slice along another location would yield different but approximately the same thickness. The areas with a refractive index of 1.0 are voids that are filled with air and the remaining layers are polypropylene.

TABLE 2

| Sublayer of L3 | Refractive Index | Thickness, μm |
|---|---|---|
| 1 | 1.49 | 2.54 |
| 2 | 1 | 1.527 |
| 3 | 1.49 | 2.79 |
| 4 | 1 | 1.016 |
| 5 | 1.49 | 1.778 |
| 6 | 1 | 1.016 |
| 7 | 1.49 | 2.286 |
| 8 | 1 | 1.016 |
| 9 | 1.49 | 2.032 |
| 10 | 1 | 0.762 |
| 11 | 1.49 | 2.032 |
| 12 | 1 | 1.016 |
| 13 | 1.49 | 1.778 |
| 14 | 1 | 1.016 |
| 15 | 1.49 | 2.286 |

Silver chloride emulsions were chemically and spectrally sensitized as described below. A biocide comprising a mixture of N-methyl-isothiazolone and N-methyl-5-chloroisthiazolone was added after sensitization.

Blue Sensitive Emulsion (Blue EM-1)

A high chloride silver halide emulsion is precipitated by adding approximately equimolar silver nitrate and sodium chloride solutions into a well-stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-mehtylthiazole)-pentachloroiridate, a small amount of KI solution, and shelling without any dopant. The resultant emulsion contains cubic shaped grains having edge length of 0.6 μm. The emulsion is optimally sensitized by the addition of a colloidal suspension of aurous sulfide and heat ramped to 60° C., during which time blue sensitizing dye BSD-4, potassium hexchloroiridate, Lippmann bromide, and 1-(3-acetamidophenyl)-5-mercaptotetrazole were added.

Green Sensitive Emulsion (Green EM-1)

A high chloride silver halide emulsion is precipitated by adding approximately equimolar silver nitrate and sodium chloride solutions into a well-stirred reactor containing gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic shaped grains of 0.3 μm in edge length size. The emulsion is optimally sensitized by the addition of glutaryldiaminophenyl-disulfide, a colloidal suspension of aurous sulfide and heat ramped to 55° C., during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1)

A high chloride silver halide emulsion is precipitated by adding approximately equimolar silver nitrate and sodium chloride solutions into a well-stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 μm in edge length size. The emulsion is optimally sensitized by the addition of glutaryldiaminophenyldisulfide, sodium thiosulfate, tripotassium bis{2-[3-(2-sulfobenzamido)phenyl]-mercaptotetrazole} gold(I) and heat ramped to 64° C., during which time 1-(3-acetamidophenyl)-5-mercaptotetrazole, potassium hexachloroiridate, and potassium bromide are added. The emulsion is then cooled to 40° C., pH adjusted to 6.0, and red sensitizing dye RSD-1 is added.

Coupler dispersions were emulsified by methods well known to the art, and the following layers were coated on the following support:

The following light sensitive silver halide imaging layers were utilized to prepare photographic print materials utilizing the invention support material and the control support material. The following imaging layers were coated utilizing curtain coating:

| Layer | Item | Laydown (g/m$^2$) |
|---|---|---|
| Layer 1 | Blue Sensitive Layer | |
| | Gelatin | 1.3127 |
| | Blue sensitive silver (Blue BM-1) | 0.2399 |
| | Y-4 | 0.4143 |
| | ST-23 | 0.4842 |
| | Tributyl Citrate | 0.2179 |
| | ST-24 | 0.1211 |
| | ST-16 | 0.0095 |
| | Sodium Phenylmercaptotetrazole | 0.0001 |
| | Piperidino hexose reductone | 0.0024 |
| | 5-chloro-2-methyl-4-isothiazolin-3-one/2-methyl-4-isothiazolin-3-one(3/1) | 0.0002 |
| | SF-1 | 0.0366 |
| | Potassium chloride | 0.0204 |
| | Dye-1 | 0.0148 |
| Layer 2 | Interlayer | |
| | Gelatin | 0.7532 |
| | ST-4 | 0.1076 |
| | S-3 | 0.1969 |
| | 5-chloro-2-methyl-4-isothiazolin-3-one/2-methyl-4-isothiazolin-3 -one(3/1) | 0.0001 |
| | Catechol disulfonate | 0.0323 |
| | SF-1 | 0.0081 |
| Layer 3 | Green Sensitive Layer | |
| | Gelatin | 1.1944 |
| | 1) | 0.1011 |
| | M-4 | 0.2077 |
| | Oleyl Alcohol | 0.2174 |
| | S-3 | 0.1119 |
| | ST-21 | 0.0398 |
| | ST-22 | 0.2841 |
| | Dye-2 | 0.0073 |
| | 5-chloro-2-methyl-4-isothiazolin-3-one/2-methyl-4-isothiazolin-3-one(3/1) | 0.0001 |
| | SF-1 | 0.0236 |
| | Potassium chloride | 0.0204 |
| | Sodium Phenylmercaptotetrazole | 0.0007 |
| Layer 4 | M/C Interlayer | |
| | Gelatin | 0.7532 |
| | ST-4 | 0.1076 |
| | S-3 | 0.1969 |
| | Acrylamidelt-Butylacrylamide sulfonate copolymer | 0.0541 |
| | Bis-vinylsulfonylmethane | 0.1390 |
| | 3,5-Dinitrobenzoic acid | 0.0001 |
| | Citric acid | 0.0007 |
| | Catechol disulfonate | 0.0323 |
| | 5-chloro-2-methyl-4-isothiazolin-3-one/2-methyl-4-isothiazolin-3-one(3/1) | 0.0001 |
| Layer 5 | Red Sensitive Layer | |
| | Gelatin | 1.3558 |
| | Red Sensitive silver (Red EM-1) | 0.1883 |
| | IC-35 | 0.2324 |
| | IC-36 | 0.0258 |
| | UV-2 | 0.3551 |
| | Dibutyl sebacate | 0.4358 |
| | S-6 | 0.1453 |
| | Dye-3 | 0.0229 |
| | Potassium p-toluenethiosulfonate | 0.0026 |
| | 5 -chloro-2-methyl-4-isothiazolin-3-one/2-methyl-4-isothiazolin-3 -one(3/1) | 0.0001 |
| | Sodium Phenylmercaptotetrazole | 0.0005 |
| | SF-1 | 0.0524 |
| Layer 6 | UV Overcoat | |
| | Gelatin | 0.8231 |
| | UV-1 | 0.0355 |
| | UV-2 | 0.2034 |
| | ST-4 | 0.0655 |
| | SF-1 | 0.0125 |
| | S-6 | 0.0797 |

-continued

| Layer | Item | Laydown (g/m$^2$) |
|---|---|---|
| | 5-chloro-2-methyl-4-isothiazolin-3-one/2-methyl-4-isothiazolin-3-one(3/1) | 0.0001 |
| Layer 7 | SOC | |
| | Gelatin | 0.6456 |
| | Ludox AM ™(colloidal silica) | 0.1614 |
| | Polydimethylsiloxane (DC200 ™) | 0.0202 |
| | 5-chloro-2-methyl-4-isothiazolin-3-one/2-methyl-4-isothiazolin-3-one(3/1) | 0.0001 |
| | SF-2 | 0.0032 |
| | Tergitol 15-S-5 ™ (surfactant) | 0.0020 |
| | SF-1 | 0.0081 |
| | Aerosol OT ™ (surfactant) | 0.0029 |

The structure of photographic element of the invention was the following:

Digital silver halide imaging layer from above
Top biaxially oriented, microvoided polyolefin sheet containing $TiO_2$, blue tint, and optical brightener
Polyethylene Methylacrylate adhesive layer with 18% anatase $TiO_2$
Subbed each side polyester base (4 mils)
Polyethylene Methylacrylate adhesive layer with 14% anatase $TiO_2$
Bottom biaxially oriented polyolefin sheet
Semiconductive metal oxide particles The invention and the control photographic materials were measured for MD/CD stiffness, Federal profiler, L*, opacity, MTF, tear resistance, density minimum, low toe, toe, and shoulder. The bending stiffness of the control and invention were measured by using the Lorentzen and Wettre stiffness tester, Model 16D. The output from this instrument is force, in millinewtons, required to bend the cantilevered, unclasped end of a sample 20 mm long and 38.1 mm wide at an angle of 15 degrees from the unloaded position. L* or lightness and opacity was measured for using a Spectrogard spectrophotometer, CIE system, using illuminant D6500. The test results for the above tests are listed in Table 3 below.

The surface roughness of the emulsion side of each photographic element was measured by a Federal Profiler at three stages of sample preparation, in the paper base form, after extrusion lamination and after silver halide emulsion coating. The Federal Profiler instrument consists of a motorized drive nip which is tangent to the top surface of the base plate. The sample to be measured is placed on the base plate and fed through the nip. A micrometer assembly is suspended above the base plate. The end of the micrometer spindle provides a reference surface from which the sample thickness can be measured. This flat surface is 0.95 cm diameter and, thus, bridges all fine roughness detail on the upper surface of the sample. Directly below the spindle, and nominally flush with the base plate surface, is a moving hemispherical stylus of the gauge head. This stylus responds to local surface variation as the sample is transported through the gauge. The stylus radius relates to the spatial content that can be sensed. The output of the gauge amplifier is digitized to 12 bits. The sample rate is 500 measurements per 2.5 cm. The thickness of the product was measured with a Mitutoyo digital linear gauge using a measurement probe head of 20 mm$^2$. The test results for the above tests are listed in Table 3 below.

Sharpness, or the ability to replicate fine details of the image, was measured by mathematical calculations utilizing a method is called the MTF or Modulation Transfer Function. In this test, a fine repeating sinusoidal pattern of photographic density variation near the resolution of the human eye was exposed on a photographic print. When the image was developed, the resulting density variation was compared to the expected density, and a ratio was obtained to determine the magnitude of the transfer coefficient at that frequency. A number of 100 denotes perfect replication, and this number was relatively easy to obtain at spatial frequencies of 0.2 cycle/mm. At a finer spacing of 2.0 cycles/mm, typical color photographic prints have a 70 rating or 70% replication. The test results for the above tests are listed in Table 3 below.

The D LogH characteristic curves were generated for the invention and control materials by electromodulated separation exposures (raster scanned) at 125 nanoseconds. The exposures were processed in conventional RA-4 development chemistry and read on a Status A reflection densitometer. The curves were plotted, and density minimum (Dmin), low toe, and toe values were taken from the plots. The Figure shows a D LogH characteristic curve. The Dmin value 2 is the intercept of the curve on the density axis, 4 is the low toe value, 6 is the toe value and 8 is the speed point. The values from the D LogH characteristic curves are listed in Table 4 below.

TABLE 3

| Performance Measure | Control | Invention |
|---|---|---|
| MD Stiffness (millinewtons) | 173 | 210 |
| CD Stiffness (millinewtons) | 94 | 207 |
| L* | 93 | 94.2 |
| Opacity | 93 | 95.5 |
| MTF | 71 | 81 |
| Tear Strength (N) | 129 | 707 |

TABLE 4

| | Control | | | Invention | | |
|---|---|---|---|---|---|---|
| | cyan | magenta | yellow | cyan | magenta | yellow |
| Dmin | 0.093 | 0.097 | 0.100 | 0.075 | 0.071 | 0.070 |
| Low Toe | 0.180 | 0.230 | 0.186 | 0.168 | 0.212 | 0.169 |
| Toe | 0.379 | 0.452 | 0.397 | 0.381 | 0.447 | 0.397 |

The data in Table 3 above comparing the invention to the control material show that the invention is clearly superior to the prior art photographic papers. The MD/CD stiffness for the invention is balanced; that is, the MD and CD stiffness is roughly equal, creating a photographic image that is balanced in stiffness which is perceptually preferred over the control photographic paper which is much stronger in the machine direction compared the cross direction. The tear resistance of the invention (707 N) is significantly improved over control material (129 N) resulting in improved image durability compared to prior art photographic color papers. The L* and opacity for the invention is higher than that of the control leading to an image that is brighter and has less show through compared to the control material. Image sharpness or the perceived clarity with which elements of an image are distinguished from one another was substantially improved over the control material. The invention MTF was 81 compared to a MTF of 71 for the control. A 10 unit increase in MFT is significant in that it reduces digital printing artifacts. The improvement in image sharpness for the invention is a function of higher weight percent of $TiO_2$ and the microvoided layer.

The data from Table 4 clearly demonstrate the digital printing advantages that the invention has compared to the control. The low toe values from the D LogH characteristic curves generated for the invention show a significant improvement compared to the control in the lower scale regions. The Dmin values for the invention improved by 24% for the cyan record, 36% for the magenta record, and 42% for the yellow record. As a result, it was found that the cyan low toe improved by 7%, the magenta low toe improved by 8%, and the yellow low toe improved by 10%, while maintaining an acceptable toe position. Since the Status A measurements include the base coloration (e.g., not density minimum corrected as would occur in typical print viewing), a significant portion of the low toe density measurement incorporates the Dmin. As density increases, this base Dmin contribution diminishes. The combination of the low toe improvement, lower density minimum for the invention compared to the control, and a higher MTF for the invention yields as significant improvement in digital printing quality, minimizing many of the digital printing artifacts that occur in this region of the characteristic curve and that are typical for prior art photographic papers. This low toe improvement and reduced minimum density served to reduce digital printing artifacts in digitally printed images. The improved Dmin for the invention also serves to increase the dye gamut of printed images. Finally, the reduction of digital printing artifacts combined with higher image sharpness, higher brightness, reduced Dmin, and improved image tear resistance yields an image that is superior to prior art photographic papers and, thus, has significant commercial value.

The invention has been described in detail with particular reference to certain preferred embodiments thereof, but it will be understood that variations and modifications can be effected within the spirit and scope of the invention.

What is claimed is:

1. A reflective base photographic element comprising a support material comprising a microvoided biaxially oriented polymer sheet having an upper surface L* of at least 94.2 and photosensitive silver halide containing imaging layers wherein said imaging layers have an exposure range of between 125 to 0.5 when there is a Status A reflection density shoulder loss of no more than 8 percent as a function of the cyan record, wherein said photographic element has an exposure range of at least 125 nanoseconds to 0.5 seconds when there is a Status A reflection density shoulder loss of no more than 8 percent as a function of the magenta color record, wherein said photographic element has an exposure range of at least 125 nanoseconds to 0.5 seconds when there is a Status A reflection density shoulder loss of no more than 4 percent as a function of the yellow color record, and wherein said photographic element has a Status A reflection density minimum of less than 0.100 in the cyan layer, has a Status A reflection density minimum of less than 0.100 in the magenta layer, has a Status A reflection density minimum of less than 0.08 in the yellow layer, and a modulation transfer function (MTF) of at least 78.0, and a cyan Dmax of at least 2.53, a magenta Dmax of at least 2.34, and a yellow Dmax of at least 2.16 wherein between the photosensitive layers and a microvoided layer of an upper microvoided sheet there is at least one layer of polypropylene comprising between 18 and 24% $TiO_2$.

2. The element of claim 1 wherein said element comprises a paper sheet below said biaxially oriented polymer sheet and a biaxially oriented polymer sheet on the side opposite said photosensitive imaging layers.

3. The element of claim 1 wherein silver halide grains of the imaging layers of said full color photographic element are comprised of at least 90 percent silver chloride and further comprise an iridium coordination complex containing a thiazole or substituted thiazole ligand.

4. The element of claim 3 further comprising a hexacoordination metal complex which satisfies the formula:

$$[ML_6]^n \quad (I)$$

wherein n is zero, −1, −2, −3 or −4;

M is a filled frontier orbital polyvalent metal ion, other than iridium; and $L_6$ represents bridging ligands which can be independently selected, provided that at least four of the ligands are anionic ligands, and at least one of the ligands is a cyano ligand or a ligand more electronegative than a cyano ligand.

5. The element of claim 1 wherein the biaxially oriented polymer sheet comprises a polyester sheet.

6. The element of claim 1 wherein none of the silver halide containing layers contain greater than 0.25 $mg/m^2$ silver.

7. The element of claim 1 wherein the biaxially oriented polymer sheet comprises at least one layer comprising polyethylene.

8. The element of claim 1 wherein said substrate has an L* greater than 95.0.

9. A radiation-sensitive emulsion according to claim 3 wherein a class (i) dopant is located within the central portion of grains in an interior region surrounding at least 50 percent of the total silver forming the grains and is present in a concentration of from $10^{-8}$ to $10^{-3}$ mole per mole of silver, and a class (ii) dopant is located within the central portion of the grains in a sub-surface shell region surrounding at least 50 percent of the total silver forming the grains and is present in a concentration of from $10^{-9}$ to $10^{-4}$ mole per mole of silver.

10. The element of claim 1 wherein the biaxially oriented polymer sheet comprises at least one layer comprising optical brightener.

11. The element of claim 1 further comprising a paper base that has an apparent density of between 1.05 grams/cc and 1.21 grams/cc.

12. The element of claim 1 wherein there is provided between said overlaying biaxially oriented polymer sheet and a base an adhesive layer comprising white pigments.

13. The element of claim 2 wherein the opposite side biaxially oriented polymer sheet is provided with multicolor indicia on the upper side.

14. The element of claim 2 wherein said paper base is provided with multicolor indicia on its lower surface.

15. The element of claim 1 wherein said element comprises

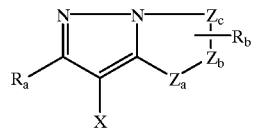

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

16. The element of claim 1 wherein said element comprises

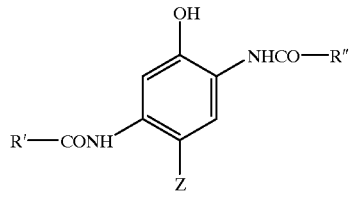

wherein

R' and R" are substituents selected such that the coupler is a "NB coupler", as herein defined; and Z is a hydrogen atom or a group which can be split off by the reaction of the coupler with an oxidized color developing agent.

17. The element of claim 1 wherein said element comprises

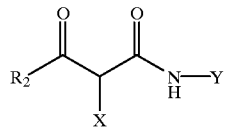

wherein $R_2$ represents a substituent, X is hydrogen or a coupling-off group; Y represents an aryl group or a heterocyclic group; and $Q_3$ represents an organic residue required to form a nitrogen-containing heterocyclic group together with the >N—.

* * * * *